US011543180B2

(12) United States Patent
Cuellar et al.

(10) Patent No.: US 11,543,180 B2
(45) Date of Patent: Jan. 3, 2023

(54) HYDROCARBON GAS PROCESSING

(71) Applicants: UOP LLC, Des Plaines, IL (US); S.M.E. Products LP, Houston, TX (US)

(72) Inventors: Kyle T. Cuellar, Katy, TX (US); Michael C. Pierce, Erie, CO (US); Scott A. Miller, Midland, TX (US); John D. Wilkinson, Midland, TX (US); Joe T. Lynch, Midland, TX (US); Hank M. Hudson, Midland, TX (US); Andrew F. Johnke, Beresford, SD (US); W. Larry Lewis, Tomball, TX (US)

(73) Assignee: UOP LLC, Des Plaines, IL (US)

( * ) Notice: Subject to any disclaimer, the term of this patent is extended or adjusted under 35 U.S.C. 154(b) by 174 days.

(21) Appl. No.: 15/988,639

(22) Filed: May 24, 2018

(65) Prior Publication Data

US 2018/0347899 A1 Dec. 6, 2018

Related U.S. Application Data

(60) Provisional application No. 62/667,833, filed on May 7, 2018, provisional application No. 62/513,851, filed on Jun. 1, 2017.

(51) Int. Cl.
*F25J 3/02* (2006.01)

(52) U.S. Cl.
CPC ..... *F25J 3/0238* (2013.01); *F25J 3/0209* (2013.01); *F25J 3/0233* (2013.01); *F25J 3/0242* (2013.01);
(Continued)

(58) Field of Classification Search
CPC ..... F25J 3/0209; F25J 3/0233; F25J 3/0238; F25J 2200/70; F25J 2205/04;
(Continued)

(56) References Cited

U.S. PATENT DOCUMENTS 33,408 A 10/1861 Turner et al.
311,402 A 1/1885 Withington
(Continued)

FOREIGN PATENT DOCUMENTS

EP 0182643 A2 5/1986
EP 1114808 A1 7/2001
(Continued)

OTHER PUBLICATIONS

Supplemental Notice of Allowability issued in U.S. Appl. No. 12/689,616, dated Feb. 10, 2015 (12 pages).
(Continued)

*Primary Examiner* — Brian M King
(74) *Attorney, Agent, or Firm* — Paschall & Associates, LLC; Mark Goldberg

(57) ABSTRACT

A process and an apparatus are disclosed for a compact processing assembly to improve the recovery of $C_2$ (or $C_3$) and heavier hydrocarbon components from a hydrocarbon gas stream. The preferred method of separating a hydrocarbon gas stream generally includes producing at least a substantially condensed first stream and a cooled second stream, expanding both streams to lower pressure, and supplying the streams to a fractionation tower. In the process and apparatus disclosed, the tower overhead vapor is directed to an absorbing means and a heat and mass transfer means inside a processing assembly. A portion of the outlet vapor from the processing assembly is compressed to higher pressure, cooled and substantially condensed in a heat exchange means inside the processing assembly, then
(Continued)

expanded to lower pressure and supplied to the heat and mass transfer means to provide cooling. Condensed liquid from the absorbing means is fed to the tower.

3 Claims, 17 Drawing Sheets

(52) U.S. Cl.
CPC ..... *F25J 3/0295* (2013.01); *F25J 2200/02* (2013.01); *F25J 2200/30* (2013.01); *F25J 2200/74* (2013.01); *F25J 2200/76* (2013.01); *F25J 2200/80* (2013.01); *F25J 2205/04* (2013.01); *F25J 2205/50* (2013.01); *F25J 2210/06* (2013.01); *F25J 2215/04* (2013.01); *F25J 2215/62* (2013.01); *F25J 2230/08* (2013.01); *F25J 2235/02* (2013.01); *F25J 2235/60* (2013.01); *F25J 2240/02* (2013.01); *F25J 2240/40* (2013.01); *F25J 2245/02* (2013.01); *F25J 2270/02* (2013.01); *F25J 2270/08* (2013.01); *F25J 2270/88* (2013.01); *F25J 2280/02* (2013.01); *F25J 2290/40* (2013.01)

(58) Field of Classification Search
CPC .. F25J 2200/76; F25J 2205/50; F25J 2245/42; F25J 2245/90; F25J 2270/60
See application file for complete search history.

(56) References Cited

U.S. PATENT DOCUMENTS 2,603,310 A 7/1952 Gilmore
2,880,592 A 4/1959 Davison et al.
2,952,984 A 9/1960 Marshall
2,952,985 A 9/1960 Brandon
3,292,380 A 12/1966 Bucklin
3,292,980 A 12/1966 Gustafsson et al.
3,477,915 A 11/1969 Gantt et al.
3,507,127 A 4/1970 Marco
3,508,412 A 4/1970 Yearout
3,516,261 A 6/1970 Hoffman
3,524,897 A 8/1970 Kniel
3,625,017 A 12/1971 Hoffman
3,656,311 A 4/1972 Kaiser
3,675,435 A 7/1972 Jackson et al.
3,724,226 A 4/1973 Pachaly
3,763,658 A 10/1973 Gaumer, Jr. et al.
3,797,261 A 3/1974 Juncker et al.
3,837,172 A 9/1974 Markbreiter et al.
3,902,329 A 9/1975 King, III et al.
3,920,767 A 11/1975 Carter
3,969,450 A 7/1976 Hengstebeck
3,983,711 A 10/1976 Solomon
4,002,042 A 1/1977 Pryor et al.
4,004,430 A 1/1977 Solomon et al.
4,033,735 A 7/1977 Swenson
4,061,481 A 12/1977 Campbell et al.
4,065,278 A 12/1977 Newton et al.
4,115,086 A 9/1978 Jordan et al.
4,127,009 A 11/1978 Phillips
4,132,604 A 1/1979 Alexion et al.
4,140,504 A 2/1979 Campbell et al.
4,157,904 A 6/1979 Campbell et al.
4,171,964 A 10/1979 Campbell et al.
4,185,978 A 1/1980 McGalliard et al.
4,203,741 A 5/1980 Bellinger et al.
4,251,249 A 2/1981 Gulsby
4,278,457 A 7/1981 Campbell et al.
4,284,423 A 8/1981 Eakman et al.
4,318,723 A 3/1982 Holmes et al.
4,322,225 A 3/1982 Bellinger et al.
4,356,014 A 10/1982 Higgins
4,368,061 A 1/1983 Mestrallet et al.
4,404,008 A 9/1983 Rentler et al.
4,430,103 A 2/1984 Gray et al.
4,445,916 A 5/1984 Newton
4,445,917 A 5/1984 Chiu
4,453,958 A 6/1984 Gulsby et al.
4,507,133 A 3/1985 Khan et al.
4,519,824 A 5/1985 Huebel
4,525,185 A 6/1985 Newton
4,545,795 A 10/1985 Liu et al.
4,592,766 A 6/1986 Kumman et al.
4,596,588 A 6/1986 Cook
4,600,421 A 7/1986 Kummann
4,617,039 A 10/1986 Buck
4,657,571 A 4/1987 Gazzi
4,676,812 A 6/1987 Kummann
4,687,499 A 8/1987 Aghili
4,688,399 A 8/1987 Reimann
4,689,063 A 8/1987 Paradowski et al.
4,690,702 A 9/1987 Paradowski et al.
4,698,081 A 10/1987 Aghili
4,705,549 A 11/1987 Sapper
4,707,170 A 11/1987 Ayres et al.
4,710,214 A 12/1987 Sharma et al.
4,711,651 A 12/1987 Sharma et al.
4,718,927 A 1/1988 Bauer et al.
4,720,294 A 1/1988 Lucadamo et al.
4,738,699 A 4/1988 Apffel
4,746,342 A 5/1988 DeLong et al.
4,752,312 A 6/1988 Prible
4,755,200 A 7/1988 Liu et al.
4,793,841 A 12/1988 Burr
4,851,020 A 7/1989 Montgomery, IV
4,854,955 A 8/1989 Campbell et al.
4,869,740 A 9/1989 Campbell et al.
4,881,960 A 11/1989 Ranke et al.
4,889,545 A 12/1989 Campbell et al.
4,895,584 A 1/1990 Buck et al.
RE33,408 E 10/1990 Khan et al.
4,966,612 A 10/1990 Bauer
4,970,867 A 11/1990 Herron et al.
5,114,451 A 5/1992 Rambo et al.
5,114,541 A 5/1992 Bayer
5,255,528 A 10/1993 Dao
5,275,005 A 1/1994 Campbell et al.
5,282,507 A 2/1994 Tongu et al.
5,291,736 A 3/1994 Paradowski
5,316,628 A 5/1994 Collin et al.
5,325,673 A 7/1994 Durr et al.
5,335,504 A 8/1994 Durr et al.
5,339,654 A 8/1994 Cook et al.
5,363,655 A 11/1994 Kikkawa et al.
5,365,740 A 11/1994 Kikkawa et al.
5,367,884 A 11/1994 Phillips et al.
5,410,885 A 5/1995 Smolarek et al.
5,421,165 A 6/1995 Paradowski et al.
5,537,827 A 7/1996 Low et al.
5,546,764 A 8/1996 Mehra
5,555,748 A 9/1996 Campbell et al.
5,566,554 A 10/1996 Vijayaraghavan et al.
5,568,737 A 10/1996 Campbell et al.
5,600,969 A 2/1997 Low
5,615,561 A 4/1997 Houshmand et al.
5,651,269 A 7/1997 Prevost et al.
5,669,234 A 9/1997 Houser et al.
5,675,054 A 10/1997 Manley et al.
5,685,170 A 11/1997 Sorensen
5,713,216 A 2/1998 Erickson
5,737,940 A 4/1998 Yao et al.
5,755,114 A 5/1998 Foglietta
5,755,115 A 5/1998 Manley
5,771,712 A 6/1998 Campbell et al.
5,799,507 A 9/1998 Wilkinson et al.
5,881,569 A 3/1999 Campbell et al.
5,890,377 A 4/1999 Foglietta
5,890,378 A 4/1999 Rambo et al.
5,893,274 A 4/1999 Nagelvoort et al.
5,942,164 A 8/1999 Tran
5,950,453 A 9/1999 Bowen et al.

(56) References Cited

U.S. PATENT DOCUMENTS 5,970,742 A 10/1999 Agrawal et al.
5,983,664 A 11/1999 Campbell et al.
5,992,175 A 11/1999 Yao et al.
6,014,869 A 1/2000 Elion et al.
6,016,665 A 1/2000 Cole et al.
6,023,942 A 2/2000 Thomas et al.
6,053,007 A 4/2000 Victory et al.
6,062,041 A 5/2000 Kikkawa et al.
6,077,985 A 6/2000 Stork
6,116,050 A 9/2000 Yao et al.
6,119,479 A 9/2000 Roberts et al.
6,125,653 A 10/2000 Shu et al.
6,182,469 B1 2/2001 Campbell et al.
6,237,365 B1 5/2001 Trebble
6,244,070 B1 6/2001 Lee et al.
6,250,105 B1 6/2001 Kimble
6,269,655 B1 8/2001 Roberts et al.
6,272,882 B1 8/2001 Hodges et al.
6,308,531 B1 10/2001 Roberts et al.
6,324,867 B1 12/2001 Fanning et al.
6,336,344 B1 1/2002 O'Brien
6,347,532 B1 2/2002 Agrawal et al.
6,361,582 B1 3/2002 Pinnau et al.
6,363,744 B2 4/2002 Finn et al.
6,367,286 B1 4/2002 Price
6,401,486 B1 6/2002 Lee et al.
6,417,420 B1 7/2002 Stewart et al.
6,453,698 B2 9/2002 Jain et al.
6,516,631 B1 2/2003 Trebble
6,526,777 B1 3/2003 Campbell et al.
6,550,274 B1 4/2003 Agrawal
6,564,579 B1 5/2003 McCartney
6,565,626 B1 5/2003 Baker et al.
6,578,379 B2 6/2003 Paradowski
6,604,380 B1 8/2003 Reddick et al.
6,694,775 B1 2/2004 Higginbotham et al.
6,712,880 B2 * 3/2004 Foglietta ..... F25J 3/0209 95/184
6,742,358 B2 * 6/2004 Wilkinson ..... F25J 1/0214 62/613
6,889,523 B2 5/2005 Wilkinson et al.
6,907,752 B2 6/2005 Schroeder et al.
6,915,662 B2 7/2005 Wilkinson et al.
6,941,771 B2 9/2005 Reddick et al.
6,945,075 B2 9/2005 Wilkinson et al.
6,986,266 B2 1/2006 Narinsky
7,010,937 B2 3/2006 Wilkinson et al.
7,069,743 B2 7/2006 Prim
7,107,788 B2 9/2006 Patel et al.
7,155,931 B2 1/2007 Wilkinson et al.
7,159,417 B2 1/2007 Foglietta et al.
7,165,423 B2 1/2007 Winningham
7,191,617 B2 3/2007 Cuellar et al.
7,204,100 B2 4/2007 Wilkinson et al.
7,210,311 B2 5/2007 Wilkinson et al.
7,216,507 B2 5/2007 Cuellar et al.
7,219,513 B1 5/2007 Mostafa
7,273,542 B2 9/2007 Duhon et al.
7,278,281 B2 10/2007 Yang et al.
7,310,971 B2 12/2007 Eaton et al.
7,316,127 B2 1/2008 Huebel et al.
7,357,003 B2 4/2008 Ohara et al.
7,475,566 B2 1/2009 Schroeder et al.
7,565,815 B2 7/2009 Wilkinson et al.
7,631,516 B2 12/2009 Cuellar et al.
7,666,251 B2 2/2010 Shah et al.
7,713,497 B2 5/2010 Mak
7,714,180 B2 5/2010 Duhon et al.
7,793,517 B2 9/2010 Patel et al.
8,156,758 B2 4/2012 Denton et al.
8,434,325 B2 5/2013 Martinez et al.
8,555,672 B2 * 10/2013 Turner ..... F25J 1/0045 62/613
8,590,340 B2 * 11/2013 Pitman ..... F25J 3/0209 62/621
8,667,812 B2 3/2014 Cuellar et al.
8,794,029 B2 8/2014 Yokohata et al.
8,794,030 B2 8/2014 Martinez et al.
8,850,849 B2 10/2014 Martinez et al.
8,881,549 B2 11/2014 Johnke et al.
8,919,148 B2 12/2014 Wilkinson et al.
9,021,831 B2 5/2015 Johnke et al.
9,021,832 B2 5/2015 Pierce et al.
9,052,136 B2 6/2015 Johnke et al.
9,052,137 B2 6/2015 Johnke et al.
9,057,558 B2 6/2015 Johnke et al.
9,068,774 B2 6/2015 Johnke et al.
9,074,814 B2 * 7/2015 Johnke ..... C10G 5/04
9,080,810 B2 7/2015 Pitman et al.
9,080,811 B2 7/2015 Johnke et al.
9,476,639 B2 10/2016 Martinez et al.
9,637,428 B2 * 5/2017 Hudson ..... F25J 1/0022
9,740,147 B2 10/2017 Lynch et al.
9,790,147 B2 10/2017 Lynch et al.
9,927,171 B2 3/2018 Hudson et al.
9,933,207 B2 4/2018 Johnke et al.
9,939,195 B2 4/2018 Johnke et al.
9,939,196 B2 4/2018 Johnke et al.
2001/0008073 A1 7/2001 Finn et al.
2002/0166336 A1 11/2002 Wilkinson et al.
2003/0005722 A1 1/2003 Wilkinson et al.
2003/0158458 A1 8/2003 Prim
2004/0079107 A1 4/2004 Wilkinson et al.
2004/0172967 A1 9/2004 Patel et al.
2005/0061029 A1 3/2005 Narinsky
2005/0155381 A1 7/2005 Yang et al.
2005/0229634 A1 10/2005 Huebel et al.
2005/0247078 A1 11/2005 Wilkinson et al.
2005/0268649 A1 12/2005 Wilkinson et al.
2006/0032269 A1 2/2006 Cellar et al.
2006/0086139 A1 4/2006 Eaton et al.
2006/0130521 A1 6/2006 Patel
2006/0260355 A1 11/2006 Roberts et al.
2006/0283207 A1 12/2006 Pitman et al.
2007/0001322 A1 1/2007 Aikhorin et al.
2008/0000265 A1 1/2008 Cuellar et al.
2008/0078205 A1 4/2008 Cuellar et al.
2008/0141712 A1 6/2008 Verma
2008/0190136 A1 8/2008 Pitman et al.
2008/0271480 A1 11/2008 Mak
2008/0282731 A1 11/2008 Cuellar et al.
2009/0107174 A1 4/2009 Ambari et al.
2009/0107175 A1 4/2009 Patel et al.
2009/0113930 A1 5/2009 Patel et al.
2009/0282865 A1 11/2009 Martinez et al.
2009/0293538 A1 12/2009 Wilkinson et al.
2010/0251764 A1 10/2010 Johnke et al.
2010/0275647 A1 11/2010 Johnke et al.
2010/0287982 A1 11/2010 Martinez et al.
2010/0287983 A1 11/2010 Johnke et al.
2010/0287984 A1 11/2010 Johnke et al.
2010/0326134 A1 12/2010 Johnke et al.
2011/0067441 A1 3/2011 Martinez et al.
2011/0067442 A1 3/2011 Martinez et al.
2011/0067443 A1 * 3/2011 Martinez ..... F25J 3/0233 62/620
2011/0226011 A1 9/2011 Johnke et al.
2011/0226013 A1 * 9/2011 Johnke ..... F25J 3/0238 62/620
2011/0232328 A1 9/2011 Johnke et al.
2013/0125582 A1 5/2013 Martinez et al.
2015/0073194 A1 * 3/2015 Hudson ..... F25J 3/0209 585/802
2015/0073195 A1 3/2015 Lynch et al.
2015/0073196 A1 * 3/2015 Miller ..... B01D 3/26 585/802

(56) References Cited

U.S. PATENT DOCUMENTS

| | | | |
|---|---|---|---|
| 2015/0253074 | A1 | 9/2015 | Pitman et al. |
| 2016/0069610 | A1 | 3/2016 | Anguiano et al. |
| 2018/0058755 | A1 | 3/2018 | Hudson et al. |

FOREIGN PATENT DOCUMENTS

| | | | |
|---|---|---|---|
| FR | 1535846 | A | 8/1968 |
| GB | 2102931 | A | 2/1983 |
| SU | 1606828 | A1 | 10/1986 |
| WO | 99/23428 | A1 | 5/1999 |
| WO | 99/37962 | A1 | 7/1999 |
| WO | 00/33006 | A1 | 6/2000 |
| WO | 00/34724 | A1 | 6/2000 |
| WO | 01/88447 | A1 | 11/2001 |
| WO | 02/14763 | A1 | 2/2002 |
| WO | 2002101307 | A1 | 12/2002 |
| WO | 2004/076946 | A2 | 9/2004 |
| WO | 2004/080936 | A1 | 9/2004 |
| WO | 2004/109180 | A1 | 12/2004 |
| WO | 2005/015100 | A1 | 2/2005 |
| WO | 2005/035692 | A2 | 4/2005 |
| WO | 2007/001669 | A2 | 1/2007 |
| WO | 2008/066570 | A2 | 6/2008 |
| WO | 2009/010558 | A2 | 1/2009 |

OTHER PUBLICATIONS

Comments on Statement of Reasons for Allowance filed in U.S. Appl. No. 12/689,616, dated Mar. 3, 2015 (7 pages).
Response and Statement of Interview filed in U.S. Appl. No. 13/052,575, dated Mar. 16, 2015 (37 pages).
Response and Statement of Interview filed in U.S. Appl. No. 13/052,348, dated Mar. 17, 2015 (37 pages).
Response and Statement of Interview filed in U.S. Appl. No. 13/053,792, dated Mar. 18, 2015 (37 pages).
Response, Statement of Interview and Petition for Extension of Time filed in U .S. U.S. Appl. No. 13/051,682, dated Mar. 19, 2015 (37 pages).
Response, Statement of Interview and Petition for Extension of Time filed in U .S. U.S. Appl. No. 13/048,315, dated Mar. 20, 2015 (93 pages).
Amendment and Statement of Interview filed in U.S. Appl. No. 13/052,348, dated Mar. 26, 2015 (23 pages).
Amendment and Statement of Interview filed in U.S. Appl. No. 13/051,682, dated Mar. 26, 2015 (29 pages).
Amendment and Statement of Interview filed in U.S. Appl. No. 13/053,792, dated Mar. 26, 2015 (25 pages).
Amendment and Statement of Interview filed in U.S. Appl. No. 13/052,575, dated Mar. 26, 2015 (20 pages).
Notice of Allowance and Fee(s) Due issued in U.S. Appl. No. 12/689,616, dated Jan. 9, 2015 (15 pages).
Comments on Statement of Reasons for Allowance filed in U.S. Appl. No. 12/689,616, dated Jan. 30, 2015 (8 pages).
Office Action issued in U.S. Appl. No. 13/052,348, dated Dec. 17, 2014 (13 pages).
Office Action issued in U.S. Appl. No. 13/051,682, dated Dec. 18, 2014 (13 pages).
Office Action issued in U.S. Appl. No. 13/053,792, dated Dec. 18, 2014 (20 pages).
Office Action issued in U.S. Appl. No. 13/052,575, dated Dec. 16, 2014 (16 pages).
Advisory Action Before the Filing of an Appeal Brief issued in U.S. Appl. No. 12/689,616, dated Nov. 28, 2014 (3 pages).
Submission Under 37 C.F.R. § 1.114, Statement Of Interview, And Petition For Extension Of Time filed in U.S. Appl. No. 12/689,616, dated Dec. 8, 2014 (39 pages).
International Search Report and Written Opinion issued in International Application No. PCT/US2011/028872 dated May 18, 2011—7 pages.
International Search Report and Written Opinion issued in International Application No. PCT/US2011/29234 dated May 20, 2011—30 pages.
International Search Report and Written Opinion issued in International Application No. PCT/US2011/029034 dated Jul. 27, 2011—40 pages.
International Search Report and Written Opinion issued in International Application No. PCT/US2011/029409 dated May 17, 2011—15 pages.
International Search Report and Written Opinion issued in International Application No. PCT/US2011/029239 dated May 20, 2011—21 pages.
E. Ross Mowrey, "Efficient, High Recovery of Liquids From Natural Gas Utilizing a High Pressure Absorber," Proceedings of the Eighty-First Annual Convention of the Gas Processors Association, Dallas, Texas, Mar. 11-13, 2002.
"Dew Point Control Gas Conditioning Units," SME Products Brochure, Gas Processors Assoc. Conference (Apr. 5, 2009).
"Fuel Gas Conditioning Units for Compressor Engines," SME Products Brochure, Gas Processors Assoc. Conference (Apr. 5, 2009).
"P&ID Fuel Gas Conditioner," Drawing No. SMEP-901, Date Drawn: Aug. 29, 2007, SME, available at http//www.sme-llc.com/sme.cfm?a=prd&catID=58&subID=44&prdID=155 (Apr. 24, 2009).
"Fuel Gas Conditioner Preliminary Arrangement," Drawing No. SMP-1007-00, Date Drawn: Nov. 11, 2008, SME, available at http://www.sme-llc.com/sme.cfm?a=prd&catID=58&subID=44&prdID=155 (Apr. 24, 2009).
"Product: Fuel Gas Conditioning Units," SME Associates, LLC, available at http://www.smellc.com/sme.cfm?a=prd&catID=58&subID=44&prdID=155 (Apr. 24, 2009).
International Search Report and Written Opinion issued in International Application No. PCT/US2010/21364 dated Mar. 29, 2010—20 pages.
International Search Report and Written Opinion issued in International Application No. PCT/US2010/26185 dated Jul. 9, 2010—20 pages.
International Search Report and Written Opinion issued in corresponding International Application No. PCT/US2010/29331 dated Jul. 2, 2010—15 pages.
International Search Report and Written Opinion issued in International Application No. PCT/US2010/33374 dated July 9, 2010—18 pages.
International Search Report and Written Opinion issued in International Application No. PCT/US2010/35121 dated Jul. 19, 2010—18 pages.
International Search Report and Written Opinion issued in International Application No. PCT/US2010/37098 dated Aug. 17, 2010—12 pages.
International Search Report and Written Opinion issued in International Application No. PCT/US14/51544 dated Nov. 24, 2014—16 pages.
Huebel, R., et al., "New NGL-Recovery Process Provides Viable Alternative", Oil & Gas Journal, Jan. 9, 2012 (9 pages).
International Search Report and Written Opinion issued in International Application No. PCT/US14/51547 dated Nov. 24, 2014—21 pages.
International Search Report and Written Opinion issued in International Application No. PCT/US14/51548 dated Nov. 25, 2014—24 pages.
Lynch et al., Retrofitting the Williams Energy Services Ignacio Plant for Higher Throughput and Recovery, 78th Annual Convention of the Gas Processors Association, Mar. 3, 1999.
Lynch et al., Retrofit of the Amerada Hess Sea Robin Plant for Very High Ethane Recovery, Gas Processors Association 84th Annual Convention, Mar. 13-16, 2005.
Pending U.S. Appl. No. 15/332,670, filed Oct. 24, 2016.
Pending U.S. Appl. No. 15/332,706, filed Oct. 24, 2016.
Amendment filed in U.S. Appl. No. 11/839,693, dated Apr. 4, 2016 (146 pages).
Office Action issued in U.S. Appl. No. 11/839,693, dated Jul. 12, 2016 (29 pages).

(56) References Cited

OTHER PUBLICATIONS

Amendment and Declaration filed in U.S. Appl. No. 12/868,993, dated May 18, 2016 (71 pages).
Office Action issued in U.S. Appl. No. 12/868,993, dated Sep. 8, 2016 (26 pages).
Response filed in U.S. Appl. No. 12/772,472, dated May 16, 2016 (47 pages).
Office Action issued in U.S. Appl. No. 12/772,472, dated Aug. 23, 2016 (18 pages).
Amendment filed in U.S. Appl. No. 12/781,259, dated May 17, 2016 (40 pages).
Office Action issued in U.S. Appl. No. 12/781,259, dated Aug. 23, 2016 (15 pages).
Response filed in U.S. Appl. No. 12/792,136, dated May 17, 2016 (32 pages).
Office Action issued in U.S. Appl. No. 12/792,136, dated Aug. 22, 2016 (10 pages).
Amendment and Declaration filed in U.S. Appl. No. 12/869,139, dated May 9, 2016 (54 pages).
Office Action issued in U.S. Appl. No. 12/869,139, dated Aug. 23, 2016 (17 pages).
Pending U.S. Appl. No. 15/259,891, filed Sep. 8, 2016.
Amendment filed in U.S. Appl. No. 11/839,693, dated Jan. 12, 2017 (150 pages).
Amendment and Declaration filed in U.S. Appl. No. 12/868,993, dated Mar. 8, 2017 (47 pages).
Amendment and Declaration filed in U.S. Appl. No. 12/772,472, dated Feb. 23, 2017 (75 pages).
Applicant-Initiated Interview Summary issued in U.S. Appl. No. 12/772,472, dated Mar. 13, 2017 (4 pages).
Amendment and Declaration filed in U.S. Appl. No. 12/781,259, dated Feb. 23, 2017 (69 pages).
Applicant-Initiated Interview Summary issued in U.S. Appl. No. 12/781,259, dated Mar. 15, 2017 (4 pages).
Amendment and Declaration filed in U.S. Appl. No. 12/792,136, dated Feb. 22, 2017 (65 pages).
Applicant-Initiated Interview Summary issued in U.S. Appl. No. 12/792,136, dated Mar. 13, 2017 (4 pages).
Amendment and Declaration filed in U.S. Appl. No. 12/869,139, dated Feb. 23, 2017 (29 pages).
Office Action issued in U.S. Appl. No. 14/462,083, dated Dec. 29, 2016 (6 pages).
Response filed in U.S. Appl. No. 14/462,083, dated Mar. 10, 2017 (3 pages).
Office Action issued in U.S. Appl. No. 14/462,069, dated Dec. 30, 2016 (6 pages).
Response filed in U.S. Appl. No. 14/462,069, dated Mar. 10, 2017 (3 pages).
Office Action issued in U.S. Appl. No. 11/839,693, dated Apr. 10, 2017 (33 pages).
Office Action issued in U.S. Appl. No. 12/772,472, dated Mar. 24, 2017 (33 pages).
Response filed in U.S. Appl. No. 12/772,472, dated Apr. 7, 2017 (86 pages).
Advisory Action issued in U.S. Appl. No. 12/772,472, dated May 12, 2017 (3 pages).
Office Action issued in U.S. Appl. No. 12/781,259, dated Mar. 27, 2017 (23 pages).
Response filed in U.S. Appl. No. 12/781,259, dated Apr. 12, 2017 (76 pages).
Office Action issued in U.S. Appl. No. 12/792,136 dated Mar. 27, 2017 (19 pages).
Statement of Substance of Interview filed in U.S. Appl. No. 12/792,136, dated Apr. 13, 2017 (9 pages).
Response filed in U.S. Appl. No. 12/792,136, dated Apr. 18, 2017 (67 pages).
International Search Report and Written Opinion issued in International Application No. PCT/US17/45460 dated Oct. 27, 2017—17 pages.
International Search Report and Written Opinion issued in International Application No. PCT/US17/45457 dated Nov. 6, 2017—17 pages.
International Search Report and Written Opinion issued in International Application No. PCT/US17/45454 dated Oct. 25, 2017—17 pages.
International Search Report and Written Opinion issued in International Application No. PCT/US18/34615 dated Aug. 29, 2018—16 pages.
International Search Report and Written Opinion issued in International Application No. PCT/US18/34624 dated Aug. 29, 2018—16 pages.
International Search Report and Written Opinion issued in International Application No. PCT/US2010/062402 dated Feb. 25, 2011—11 pages.
International Search Report and Written Opinion issued in International Application No. PCT/US07/76199 dated Mar. 3, 2008—33 pages.
International Search Report and Written Opinion issued in International Application No. PCT/US2008/052154 dated Oct. 14, 2008—24 pages.
International Search Report and Written Opinion issued in International Application No. PCT/US06/18932 dated Sep. 26,2007—8 pages.
International Search Report and Written Opinion issued in International Application No. PCT/US2008/079984 dated Dec. 19, 2008—6 pages.
International Search Report and Written Opinion issued in International Application No. PCT/US2010/034732 dated Jul. 15, 2010—11 pages.
International Search Report and Written Opinion issued in International Application No. PCT/US2010/046953 dated Oct. 25, 2010—14 pages.
International Search Report and Written Opinion issued in International Application No. PCT/US2010/046966 dated Oct. 15, 2010—20 pages.
International Search Report and Written Opinion issued in International Application No. PCT/US2010/046967 dated Oct. 20, 2010—6 pages.
International Search Report and Written Opinion issued in International Application No. PCT/US2011/029409 dated May 17, 2011—14 pages.
International Search Report and Written Opinion issued in International Application No. PCT/US2011/038303 dated Sep. 2, 2011—9 pages.
FIG. 16-33 on p. 16-24 of the Engineering Data Book, Twelfth Edition, published by the Gas Processors Suppliers Association (2004).
Huang et al., "Select the Optimum Extraction Method for LNG Regasification; Varying Energy Compositions of LNG Imports may Require Terminal Operators to Remove C2+ Compounds before Injecting Regasified LNG into Pipelines," Hydrocarbon Processing, 83, 57-62, Jul. 2004.
Yang et al., "Cost-Effective Design Reduces C2 and C3 at LNG Receiving Terminals," Oil and Gas Journal, 50-53, May 26, 2003.
Finn et al., "LNG Technology for Offshore and Mid-Scale Plants," Proceedings of the Seventy-Ninth Annual Convention of the Gas Processors Association, pp. 429-450, Atlanta, Georgia, Mar. 13-15, 2000.
Kikkawa et al., "Optimize the Power System of Baseload LNG Plant," Proceedings of the Eightieth Annual Convention of the Gas Processors Association, San Antonio, Texas, Mar. 12-14, 2001.
Price, Brian C., "LNG Production for Peak Shaving Operations," Proceedings of the Seventy-Eighth Annual Convention of the Gas Processors Association, pp. 273-280, Nashville, Tennessee, Mar. 1-3, 1999.
Applicant-Initiated Interview Summary issued in U.S. Appl. No. 13/052,348, dated Feb. 20, 2015 (4 pages).
Applicant-Initiated Interview Summary issued in U.S. Appl. No. 13/053,792, dated Mar. 6, 2015 (4 pages).

(56) References Cited

OTHER PUBLICATIONS

Amendment, Statement of Interview, and Petition for Extension of Time filed in U.S. Appl. No. 12/689,616, dated Nov. 6, 2014 (30 pages).

* cited by examiner

HYDROCARBON GAS PROCESSING

BACKGROUND OF THE INVENTION

This invention relates to a process and apparatus for improving the separation of a gas containing hydrocarbons. Assignees S.M.E. Products LP and Ortloff Engineers, Ltd. were parties to a joint research agreement that was in effect before the invention of this application was made. The applicants claim the benefits under Title 35, United States Code, Section 119(e) of prior U.S. Provisional Application No. 62/513,851 which was filed on Jun. 1, 2017 and prior U.S. Provisional Application No. 62/667,833 which was filed on May 7, 2018.

Ethylene, ethane, propylene, propane, and/or heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. The gas also contains relatively lesser amounts of heavier hydrocarbons such as propane, butanes, pentanes, and the like, as well as hydrogen, nitrogen, carbon dioxide, and/or other gases.

The present invention is generally concerned with improving the recovery of ethylene, ethane, propylene, propane, and heavier hydrocarbons from such gas streams. A typical analysis of a gas stream to be processed in accordance with this invention would be, in approximate mole percent, 78.6% methane, 12.5% ethane and other $C_2$ components, 4.9% propane and other $C_3$ components, 0.6% iso-butane, 1.4% normal butane, and 1.1% pentanes plus, with the balance made up of nitrogen and carbon dioxide. Sulfur containing gases are also sometimes present.

The historically cyclic fluctuations in the prices of both natural gas and its natural gas liquid (NGL) constituents have at times reduced the incremental value of ethane, ethylene, propane, propylene, and heavier components as liquid products. This has resulted in a demand for processes that can provide more efficient recoveries of these products, for processes that can provide efficient recoveries with lower capital investment, and for processes that can be easily adapted or adjusted to vary the recovery of a specific component over a broad range. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of startup, operating flexibility, good efficiency, safety, and good reliability. U.S. Pat. Nos. 3,292,380; 4,061,481; 4,140,504; 4,157,904; 4,171,964; 4,185,978; 4,251,249; 4,278,457; 4,519,824; 4,617,039; 4,687,499; 4,689,063; 4,690,702; 4,854,955; 4,869,740; 4,889,545; 5,275,005; 5,555,748; 5,566,554; 5,568,737; 5,771,712; 5,799,507; 5,881,569; 5,890,378; 5,983,664; 6,182,469; 6,578,379; 6,712,880; 6,915,662; 7,191,617; 7,219,513; 8,590,340; 8,881,549; 8,919,148; 9,021,831; 9,021,832; 9,052,136; 9,052,137; 9,057,558; 9,068,774; 9,074,814; 9,080,810; 9,080,811; 9,476,639; 9,637,428; 9,783,470; 9,927,171; 9,933,207; and 9,939,195; reissue U.S. Pat. No. 33,408; and co-pending application Ser. Nos. 11/839,693; 12/868,993; 12/869,139; 14/714,912; 14/828,093; 15/259,891; 15/332,670; 15/332,706; 15/332,723; and 15/668,139 describe relevant processes (although the description of the present invention in some cases is based on different processing conditions than those described in the cited U.S. Patents and co-pending applications).

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ components. Depending on the richness of the gas and the amount of liquids formed, the high-pressure liquids may be expanded to a lower pressure and fractionated. The vaporization occurring during expansion of the liquids results in further cooling of the stream. Under some conditions, pre-cooling the high pressure liquids prior to the expansion may be desirable in order to further lower the temperature resulting from the expansion. The expanded stream, comprising a mixture of liquid and vapor, is fractionated in a distillation (demethanizer or deethanizer) column. In the column, the expansion cooled stream(s) is (are) distilled to separate residual methane, nitrogen, and other volatile gases as overhead vapor from the desired $C_2$ components, $C_3$ components, and heavier hydrocarbon components as bottom liquid product, or to separate residual methane, $C_2$ components, nitrogen, and other volatile gases as overhead vapor from the desired $C_3$ components and heavier hydrocarbon components as bottom liquid product.

If the feed gas is not totally condensed (typically it is not), the vapor remaining from the partial condensation can be split into two streams. One portion of the vapor is passed through a work expansion machine or engine, or an expansion valve, to a lower pressure at which additional liquids are condensed as a result of further cooling of the stream. The pressure after expansion is essentially the same as the pressure at which the distillation column is operated. The combined vapor-liquid phases resulting from the expansion are supplied as feed to the column.

The remaining portion of the vapor is cooled to substantial condensation by heat exchange with other process streams, e.g., the cold fractionation tower overhead. Some or all of the high-pressure liquid may be combined with this vapor portion prior to cooling. The resulting cooled stream is then expanded through an appropriate expansion device, such as an expansion valve, to the pressure at which the demethanizer is operated. During expansion, a portion of the liquid will vaporize, resulting in cooling of the total stream. The flash expanded stream is then supplied as top feed to the demethanizer. Typically, the vapor portion of the flash expanded stream and the demethanizer overhead vapor combine in an upper separator section in the fractionation tower as residual methane product gas. Alternatively, the cooled and expanded stream may be supplied to a separator to provide vapor and liquid streams. The vapor is combined with the tower overhead and the liquid is supplied to the column as a top column feed.

In the ideal operation of such a separation process, the residue gas leaving the process will contain substantially all of the methane in the feed gas with essentially none of the heavier hydrocarbon components, and the bottoms fraction leaving the demethanizer will contain substantially all of the heavier hydrocarbon components with essentially no methane or more volatile components. In practice, however, this ideal situation is not obtained because the conventional demethanizer is operated largely as a stripping column. The methane product of the process, therefore, typically comprises vapors leaving the top fractionation stage of the column, together with vapors not subjected to any rectification step. Considerable losses of $C_2$, $C_3$, and $C_4$+ components occur because the top liquid feed contains substantial quantities of these components and heavier hydrocarbon components, resulting in corresponding equilibrium quantities of $C_2$ components, $C_3$ components, $C_4$ components, and heavier hydrocarbon components in the vapors leaving the top fractionation stage of the demethanizer. The loss of these desirable components could be significantly reduced if the rising vapors could be brought into contact with a significant quantity of liquid (reflux) capable of absorbing the $C_2$ components, $C_3$ components, $C_4$ components, and heavier hydrocarbon components from the vapors.

In recent years, the preferred processes for hydrocarbon separation use an upper absorber section to provide additional rectification of the rising vapors. For many of these processes, the source of the reflux stream for the upper rectification section is a recycled stream of residue gas supplied under pressure. The recycled residue gas stream is usually cooled to substantial condensation by heat exchange with other process streams, e.g., the cold fractionation tower overhead. The resulting substantially condensed stream is then expanded through an appropriate expansion device, such as an expansion valve, to the pressure at which the demethanizer is operated. During expansion, a portion of the liquid will usually vaporize, resulting in cooling of the total stream. The flash expanded stream is then supplied as top feed to the demethanizer. Typical process schemes of this type are disclosed in U.S. Pat. Nos. 4,889,545; 5,568,737; 5,881,569; 9,052,137; and 9,080,811 and in Mowrey, E. Ross, "Efficient, High Recovery of Liquids from Natural Gas Utilizing a High Pressure Absorber", Proceedings of the Eighty-First Annual Convention of the Gas Processors Association, Dallas, Tex., Mar. 11-13, 2002. Unfortunately, in addition to the additional rectification section in the demethanizer, these processes also require surplus compression capacity to provide the motive force for recycling the reflux stream to the demethanizer, adding to both the capital cost and the operating cost of facilities using these processes.

Another means of providing a reflux stream for the upper rectification section is to withdraw a distillation vapor stream from a lower location on the tower (and perhaps combine it with a portion of the tower overhead vapor). This vapor (or combined vapor) stream is compressed to higher pressure, then cooled to substantial condensation, expanded to the tower operating pressure, and supplied as top feed to the tower. Typical process schemes of this type are disclosed in U.S. Pat. No. 9,476,639 and co-pending application Ser. Nos. 11/839,693; 12/869,139; and Ser. No. 15/259,891. These also require an additional rectification section in the demethanizer, plus a compressor to provide motive force for recycling the reflux stream to the demethanizer, again adding to both the capital cost and the operating cost of facilities using these processes.

However, there are many gas processing plants that have been built in the U.S. and other countries according to U.S. Pat. Nos. 4,157,904 and 4,278,457 (as well as other processes) that have no upper absorber section to provide additional rectification of the rising vapors and cannot be easily modified to add this feature. Also, these plants do not usually have surplus compression capacity to allow recycling a reflux stream. As a result, these plants are not as efficient when operated to recover $C_2$ components and heavier components from the gas (commonly referred to as "ethane recovery"), and are particularly inefficient when operated to recover only the $C_3$ components and heavier components from the gas (commonly referred to as "ethane rejection").

The present invention is a novel means of providing additional rectification that can be easily added to existing gas processing plants to increase the recovery of the desired $C_2$ components and/or $C_3$ components without requiring additional residue gas compression. The incremental value of this increased recovery is often substantial. For the Examples given later, the incremental income from the additional recovery capability over that of the prior art is in the range of US$710,000 to US$4,720,000 [€590,000 to €3,930,000] per year using an average incremental value US$0.10-0.58 per gallon [€22-129 per $m^3$] for hydrocarbon liquids compared to the corresponding hydrocarbon gases.

The present invention also combines what heretofore have been individual equipment items into a common housing, thereby reducing both the plot space requirements and the capital cost of the addition. Surprisingly, applicants have found that the more compact arrangement also significantly increases the product recovery at a given power consumption, thereby increasing the process efficiency and reducing the operating cost of the facility. In addition, the more compact arrangement also eliminates much of the piping used to interconnect the individual equipment items in traditional plant designs, further reducing capital cost and also eliminating the associated flanged piping connections. Since piping flanges are a potential leak source for hydrocarbons (which are volatile organic compounds, VOCs, that contribute to greenhouse gases and may also be precursors to atmospheric ozone formation), eliminating these flanges reduces the potential for atmospheric emissions that may damage the environment.

In accordance with the present invention, it has been found that $C_2$ recoveries in excess of 99% can be obtained. Similarly, in those instances where recovery of $C_2$ components is not desired, $C_3$ recoveries in excess of 96% can be maintained. The present invention, although applicable at lower pressures and warmer temperatures, is particularly advantageous when processing feed gases in the range of 400 to 1500 psia [2,758 to 10,342 kPa(a)] or higher under conditions requiring NGL recovery column overhead temperatures of −50° F. [−46° C.] or colder.

For a better understanding of the present invention, reference is made to the following examples and drawings. Referring to the drawings:

FIGS. 1 and 2 are flow diagrams of prior art natural gas processing plants in accordance with U.S. Pat. No. 4,157,904 or 4,278,457;

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Système International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

DESCRIPTION OF THE PRIOR ART

Figure 1:
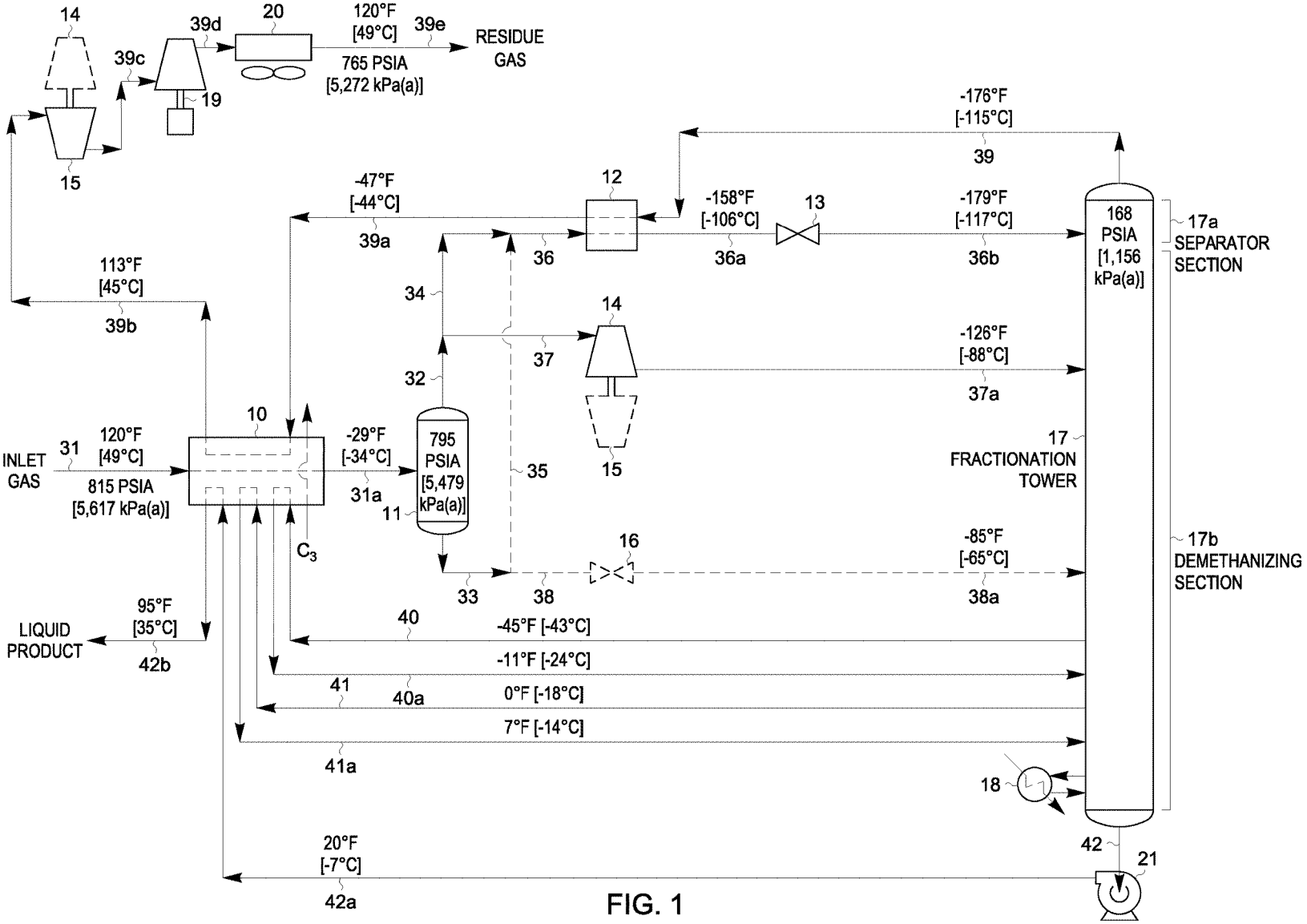
FIG. 1 (PRIOR ART)

FIG. 1 is a process flow diagram showing the design of a processing plant to recover $C_2$+ components from natural gas using prior art according to U.S. Pat. No. 4,157,904 or 4,278,457. In this simulation of the process, inlet gas enters the plant at 120° F. [49° C.] and 815 psia [5,617 kPa(a)] as stream 31. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 is cooled in heat exchanger 10 by heat exchange with cool residue gas (stream 39*a*), pumped liquid product at 20° F. [−7° C.] (stream 42*a*), demethanizer reboiler liquids at 0° F. [−18° C.] (stream 41), demethanizer side reboiler liquids at −45° F. [−43° C.] (stream 40), and propane refrigerant. Stream 31*a* then enters separator 11 at −29° F. [−34° C.] and 795 psia [5,479 kPa(a)] where the vapor (stream 32) is separated from the condensed liquid (stream 33).

The vapor (stream 32) from separator 11 is divided into two streams, 34 and 37. The liquid (stream 33) from separator 11 is optionally divided into two streams, 35 and 38. (Stream 35 may contain from 0% to 100% of the separator liquid in stream 33. If stream 35 contains any portion of the separator liquid, then the process of FIG. 1 is according to U.S. Pat. No. 4,157,904. Otherwise, the process of FIG. 1 is according to U.S. Pat. No. 4,278,457.) For the process illustrated in FIG. 1, stream 35 contains about 15% of the total separator liquid. Stream 34, containing about 30% of the total separator vapor, is combined with stream 35 and the combined stream 36 passes through heat exchanger 12 in heat exchange relation with the cold residue gas (stream 39) where it is cooled to substantial condensation. The resulting substantially condensed stream 36*a* at −158° F. [−106° C.] is then flash expanded through expansion valve 13 to the operating pressure (approximately 168 psia [1,156 kPa(a)]) of fractionation tower 17. During expansion a portion of the stream is vaporized, resulting in cooling of the total stream. In the process illustrated in FIG. 1, the expanded stream 36*b* leaving expansion valve 13 reaches a temperature of −176° F. [−115° C.] and is supplied to separator section 17*a* in the upper region of fractionation tower 17. The liquids separated therein become the top feed to demethanizing section 17*b*.

The remaining 70% of the vapor from separator 11 (stream 37) enters a work expansion machine 14 in which mechanical energy is extracted from this portion of the high pressure feed. The machine 14 expands the vapor substantially isentropically to the tower operating pressure, with the work expansion cooling the expanded stream 37*a* to a temperature of approximately −126° F. [−88° C.]. The typical commercially available expanders are capable of recovering on the order of 80-85% of the work theoretically available in an ideal isentropic expansion. The work recovered is often used to drive a centrifugal compressor (such as item 15) that can be used to re-compress the residue gas (stream 39*b*), for example. The partially condensed expanded stream 37*a* is thereafter supplied as feed to fractionation tower 17 at an upper mid-column feed point. The remaining separator liquid in stream 38 (if any) is expanded to the operating pressure of fractionation tower 17 by expansion valve 16, cooling stream 38*a* to −85° F. [−65° C.] before it is supplied to fractionation tower 17 at a lower mid-column feed point.

The demethanizer in tower 17 is a conventional distillation column containing a plurality of vertically spaced trays, one or more packed beds, or some combination of trays and packing. As is often the case in natural gas processing plants, the fractionation tower may consist of two sections. The upper section 17*a* is a separator wherein the partially vaporized top feed is divided into its respective vapor and liquid portions, and wherein the vapor rising from the lower distillation or demethanizing section 17*b* is combined with the vapor portion of the top feed to form the cold demethanizer overhead vapor (stream 39) which exits the top of the tower. The lower, demethanizing section 17*b* contains the trays and/or packing and provides the necessary contact between the liquids falling downward and the vapors rising upward. The demethanizing section 17*b* also includes reboilers (such as the reboiler and the side reboiler described previously and supplemental reboiler 18) which heat and vaporize a portion of the liquids flowing down the column to provide the stripping vapors which flow up the column to strip the liquid product, stream 42, of methane and lighter components.

The liquid product stream 42 exits the bottom of the tower at 7° F. [−14° C.], based on a typical specification of a methane concentration of 0.5% on a volume basis in the bottom product. It is pumped to higher pressure by pump 21 (stream 42*a*) and then heated to 95° F. [35° C.] (stream 42*b*) as it provides cooling of the feed gas in heat exchanger 10 as described earlier. The residue gas (demethanizer overhead vapor stream 39) passes countercurrently to the incoming feed gas in heat exchanger 12 where it is heated from −176° F. [−115° C.] to −47° F. [−44° C.] (stream 39*a*) and in heat exchanger 10 where it is heated to 113° F. [45° C.] (stream 39*b*). The residue gas is then re-compressed in two stages. The first stage is compressor 15 driven by expansion machine 14. The second stage is compressor 19 driven by a supplemental power source which compresses the residue gas (stream 39*d*) to sales line pressure. After cooling to 120° F. [49° C.] in discharge cooler 20, the residue gas product (stream 39*e*) flows to the sales gas pipeline at 765 psia [5,272 kPa(a)], sufficient to meet line requirements (usually on the order of the inlet pressure).

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Stream | Methane | Ethane | Propane | Butanes+ | Total |
|---|---|---|---|---|---|
| 31 | 17,272 | 2,734 | 1,070 | 657 | 21,961 |
| 32 | 15,282 | 1,678 | 360 | 76 | 17,613 |
| 33 | 1,990 | 1,056 | 710 | 581 | 4,348 |
| 34 | 4,541 | 499 | 107 | 23 | 5,233 |
| 35 | 298 | 158 | 107 | 87 | 652 |
| 36 | 4,839 | 657 | 214 | 110 | 5,885 |
| 37 | 10,741 | 1,179 | 253 | 53 | 12,380 |
| 38 | 1,692 | 898 | 603 | 494 | 3,696 |
| 39 | 17,236 | 90 | 2 | 0 | 17,556 |
| 42 | 36 | 2,644 | 1,068 | 657 | 4,405 |

Recoveries*

| | |
|---|---|
| Ethane | 96.69% |
| Propane | 99.84% |
| Butanes+ | 99.99% |

Power

| | | |
|---|---|---|
| Residue Gas Compression | 15,204 HP | [24,995 kW] |
| Refrigerant Compression | 3,548 HP | [5,833 kW] |
| Total Compression | 18,752 HP | [30,828 kW] |

*(Based on un-rounded flow rates)

Figure 2:
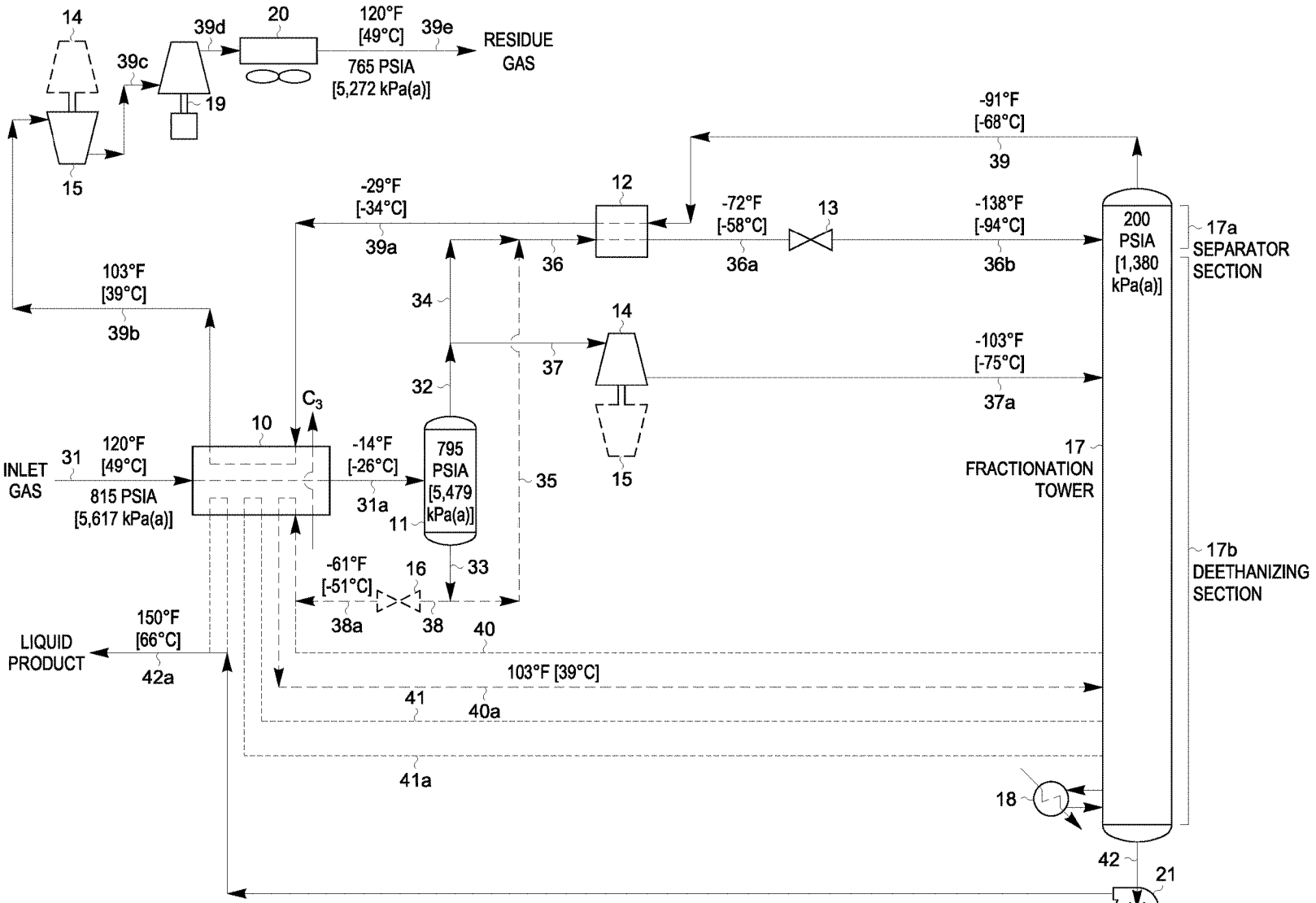
FIG. 2 (PRIOR ART)

FIG. 2 is a process flow diagram showing one manner in which the design of the processing plant in FIG. 1 can be adjusted to operate at a lower $C_2$ component recovery level. This is a common requirement when the relative values of natural gas and liquid hydrocarbons are variable, causing recovery of the $C_2$ components to be unprofitable at times. The process of FIG. 2 has been applied to the same feed gas composition and conditions as described previously for FIG. 1. However, in the simulation of the process of FIG. 2, the process operating conditions have been adjusted to reject nearly all of $C_2$ components to the residue gas rather than recovering them in the bottom liquid product from the fractionation tower.

In this simulation of the process, inlet gas enters the plant at 120° F. [49° C.] and 815 psia [5,617 kPa(a)] as stream 31 and is cooled in heat exchanger 10 by heat exchange with cool residue gas stream 39*a* and flashed separator liquids (stream 38*a*). (One consequence of operating the FIG. 2 process to reject nearly all of the $C_2$ components to the residue gas is that the temperatures of the liquids flowing down fractionation tower 17 are much warmer, to the point that side reboiler stream 40 and reboiler stream 41 are too warm to be used to cool the inlet gas, so that all of the column reboil heat must be supplied by supplemental reboiler 18. The pumped bottom product (stream 42*a*) is also too warm to be used to cool the inlet gas. In the FIG. 2 process, the flashed separator liquids are used in heat exchanger 10 in lieu of the side reboiler liquids in order to provide some cooling of the inlet gas while simultaneously reducing the duty required from supplemental reboiler 18.) Cooled stream 31*a* enters separator 11 at −14° F. [−26° C.] and 795 psia [5,479 kPa(a)] where the vapor (stream 32) is separated from the condensed liquid (stream 33).

The vapor (stream 32) from separator 11 is divided into two streams, 34 and 37, and the liquid (stream 33) is optionally divided into two streams, 35 and 38. For the process illustrated in FIG. 2, stream 35 contains about 36% of the total separator liquid. Stream 34, containing about 33% of the total separator vapor, is combined with stream 35 and the combined stream 36 passes through heat exchanger 12 in heat exchange relation with the cold residue gas (stream 39) where it is cooled to partial condensation. The resulting partially condensed stream 36*a* at −72° F. [−58° C.] is then flash expanded through expansion valve 13 to the operating pressure (approximately 200 psia [1,380 kPa(a)]) of fractionation tower 17. During expansion some of the liquid in the stream is vaporized, resulting in cooling of the total stream. In the process illustrated in FIG. 2, the expanded stream 36*b* leaving expansion valve 13 reaches a temperature of −138° F. [−94° C.] and is supplied to fractionation tower 17 at the top feed point.

The remaining 67% of the vapor from separator 11 (stream 37) enters a work expansion machine 14 in which mechanical energy is extracted from this portion of the high pressure feed. The machine 14 expands the vapor substantially isentropically to the tower operating pressure, with the work expansion cooling the expanded stream 37*a* to a temperature of approximately −103° F. [−75° C.] before it is supplied as feed to fractionation tower 17 at an upper mid-column feed point. The remaining separator liquid in stream 38 (if any) is expanded to slightly above the operating pressure of fractionation tower 17 by expansion valve 16, cooling stream 38*a* to −61° F. [−51° C.] before it is heated to 103° F. [39° C.] in heat exchanger 10 as described previously, with heated stream 40*a* then supplied to fractionation tower 17 at a lower mid-column feed point.

Note that when fractionation tower 17 is operated to reject the $C_2$ components to the residue gas product as shown in FIG. 2, the column is typically referred to as a deethanizer and its lower section 17*b* is called a deethanizing section. The liquid product stream 42 exits the bottom of deethanizer 17 at 137° F. [58° C.], based on a typical specification of an ethane to propane ratio of 0.020:1 on a volume basis in the bottom product. The residue gas (deethanizer overhead vapor stream 39) passes countercurrently to the incoming feed gas in heat exchanger 12 where it is heated from −91° F. [−68° C.] to −29° F. [−34° C.] (stream 39*a*) and in heat exchanger 10 where it is heated to 103° F. [39° C.] (stream 39*b*) as it provides cooling as described previously. The residue gas is then re-compressed in two stages, compressor 15 driven by expansion machine 14 and compressor 19 driven by a supplemental power source. After stream 39*d* is cooled to 120° F. [49° C.] in discharge cooler 20, the residue gas product (stream 39*e*) flows to the sales gas pipeline at 765 psia [5,272 kPa(a)].

A summary of stream flow rates and energy consumption for the process illustrated in FIG. 2 is set forth in the following table:

TABLE II (FIG. 2)
Stream Flow Summary - Lb. Moles/Hr [kg moles/Hr]

| Stream | Methane | Ethane | Propane | Butanes+ | Total |
|---|---|---|---|---|---|
| 31 | 17,272 | 2,734 | 1,070 | 657 | 21,961 |
| 32 | 16,003 | 1,991 | 498 | 120 | 18,835 |
| 33 | 1,269 | 743 | 572 | 537 | 3,126 |
| 34 | 5,225 | 650 | 163 | 39 | 6,149 |
| 35 | 457 | 268 | 206 | 193 | 1,125 |
| 36 | 5,682 | 918 | 369 | 232 | 7,274 |
| 37 | 10,778 | 1,341 | 335 | 81 | 12,686 |

TABLE II-continued

| (FIG. 2) Stream Flow Summary - Lb. Moles/Hr [kg moles/Hr] | | | | | |
|---|---|---|---|---|---|
| 38/40 | 812 | 475 | 366 | 344 | 2,001 |
| 39 | 17,272 | 2,715 | 116 | 8 | 20,338 |
| 42 | 0 | 19 | 954 | 649 | 1,623 |

| Recoveries* | |
|---|---|
| Propane | 89.20% |
| Butanes+ | 98.81% |

| Power | | |
|---|---|---|
| Residue Gas Compression | 15,115 HP | [24,849 kW] |
| Refrigerant Compression | 3,625 HP | [5,959 kW] |
| Total Compression | 18,740 HP | [30,808 kW] |

*(Based on un-rounded flow rates)

DESCRIPTION OF CO-PENDING APPLICATION

Figure 3:
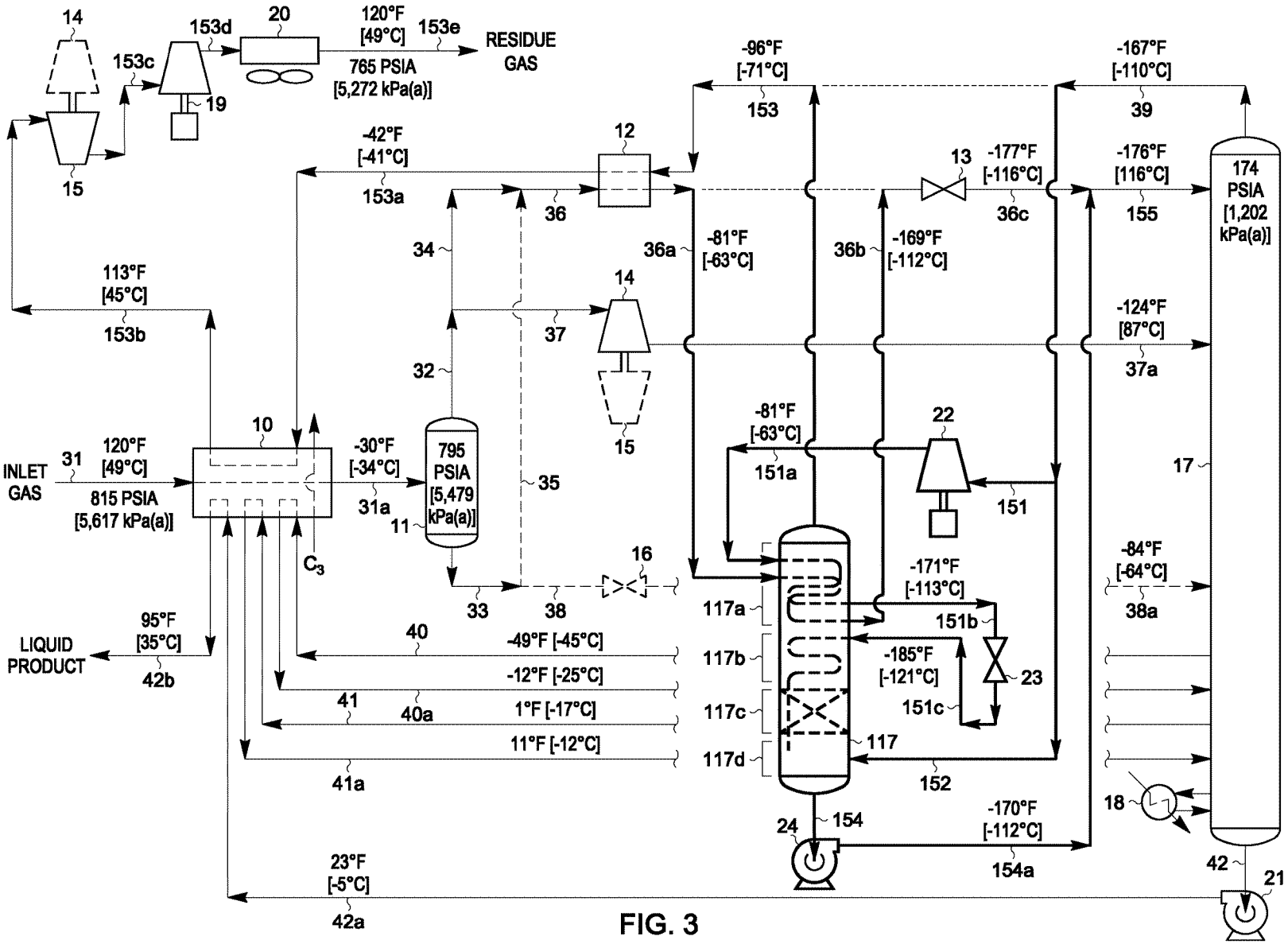
FIGS. 3 and 4 are flow diagrams of natural gas processing plants adapted to use the process of co-pending application Ser. No. 15/332,723.

Co-pending application Ser. No. 15/332,723 describes one means of improving the performance of the FIG. 1 process to recover more of the $C_2$ components in the bottom liquid product. FIG. 1 can be adapted to use this process as shown in FIG. 3. The operating conditions of the FIG. 3 process have been adjusted as shown to reduce the methane content of the liquid product to the same level as that of the FIG. 1 process. The feed gas composition and conditions considered in the process presented in FIG. 3 are the same as those in FIG. 1. Accordingly, the FIG. 3 process can be compared with that of the FIG. 1 process.

Most of the process conditions shown for the FIG. 3 process are much the same as the corresponding process conditions for the FIG. 1 process. The main difference is the disposition of substantially condensed stream 36*a* and column overhead vapor stream 39. In the FIG. 3 process, column overhead vapor stream 39 is divided into two streams, stream 151 and stream 152, whereupon stream 151 is compressed from the operating pressure (approximately 174 psia [1,202 kPa(a)]) of fractionation tower 17 to approximately 379 psia [2,616 kPa(a)] by reflux compressor 22. Compressed stream 151*a* at −81° F. [−63° C.] and substantially condensed stream 36*a* at −81° F. [−63° C.] are then directed into a heat exchange means in cooling section 117*a* of processing assembly 117. This heat exchange means may be comprised of a fin and tube type heat exchanger, a plate type heat exchanger, a brazed aluminum type heat exchanger, or other type of heat transfer device, including multi-pass and/or multi-service heat exchangers. The heat exchange means is configured to provide heat exchange between stream 151*a* flowing through one pass of the heat exchange means, substantially condensed stream 36*a* flowing through another pass of the heat exchange means, and a further rectified vapor stream arising from rectifying section 117*b* of processing assembly 117, so that stream 151*a* is cooled to substantial condensation (stream 151*b*) and stream 36*a* is further cooled (stream 36*b*) while heating the further rectified vapor stream.

Substantially condensed stream 151*b* at −171° F. [−113° C.] is then flash expanded through expansion valve 23 to slightly above the operating pressure of fractionation tower 17. During expansion a portion of the stream may be vaporized, resulting in cooling of the total stream. In the process illustrated in FIG. 3, the expanded stream 151*c* leaving expansion valve 23 reaches a temperature of −185° F. [−121° C.] before it is directed into a heat and mass transfer means in rectifying section 117*b* of processing assembly 117. This heat and mass transfer means may also be comprised of a fin and tube type heat exchanger, a plate type heat exchanger, a brazed aluminum type heat exchanger, or other type of heat transfer device, including multi-pass and/or multi-service heat exchangers. The heat and mass transfer means is configured to provide heat exchange between a partially rectified vapor stream arising from absorbing section 117*c* of processing assembly 117 that is flowing upward through one pass of the heat and mass transfer means, and the flash expanded substantially condensed stream 151*c* flowing downward, so that the partially rectified vapor stream is cooled while heating the expanded stream. As the partially rectified vapor stream is cooled, a portion of it is condensed and falls downward while the remaining vapor continues flowing upward through the heat and mass transfer means. The heat and mass transfer means provides continuous contact between the condensed liquid and the partially rectified vapor stream so that it also functions to provide mass transfer between the vapor and liquid phases, thereby providing further rectification of the partially rectified vapor stream to form the further rectified vapor stream. This further rectified vapor stream arising from the heat and mass transfer means is then directed to the heat exchange means in cooling section 117*a* of processing assembly 117 to be heated as described previously. The condensed liquid from the bottom of the heat and mass transfer means is directed to absorbing section 117*c* of processing assembly 117.

The flash expanded stream 151*c* is further vaporized as it provides cooling and partial condensation of the partially rectified vapor stream, and exits the heat and mass transfer means in rectifying section 117*b* at −178° F. [−117° C.]. The heated flash expanded stream discharges into separator section 117*d* of processing assembly 117 and is separated into its respective vapor and liquid phases. The vapor phase combines with the remaining portion (stream 152) of overhead vapor stream 39 to form a combined vapor stream that enters a mass transfer means in absorbing section 117*c* of processing assembly 117. The mass transfer means may consist of a plurality of vertically spaced trays, one or more packed beds, or some combination of trays and packing, but could also be comprised of a non-heat transfer zone in a fin and tube type heat exchanger, a plate type heat exchanger, a brazed aluminum type heat exchanger, or other type of heat transfer device, including multi-pass and/or multi-service heat exchangers. The mass transfer means is configured to provide contact between the cold condensed liquid leaving the bottom of the heat and mass transfer means in rectifying section 117*b* and the combined vapor stream arising from separator section 117*d*. As the combined vapor stream rises upward through absorbing section 117*c*, it is contacted with the cold liquid falling downward to condense and absorb $C_2$ components, $C_3$ components, and heavier components from the combined vapor stream. The resulting partially rectified vapor stream is then directed to the heat and mass transfer means in rectifying section 117*b* of processing assembly 117 for further rectification as described previously.

The liquid phase (if any) from the heated flash expanded stream leaving rectifying section 117*b* of processing assembly 117 that is separated in separator section 117*d* combines with the distillation liquid leaving the bottom of the mass transfer means in absorbing section 117*c* of processing assembly 117 to form combined liquid stream 154. Combined liquid stream 154 leaves the bottom of processing assembly 117 and is pumped to higher pressure by pump 24

(stream 154*a* at −170° F. [−112° C.]). Further cooled stream 36*b* at −169° F. [−112° C.] is flash expanded through expansion valve 13 to the operating pressure of fractionation tower 17. During expansion a portion of the stream may be vaporized, resulting in cooling of the total stream to −177° F. [−116° C.]. Flash expanded stream 36*c* then joins with pumped stream 154*a* to form combined feed stream 155, which then enters fractionation column 17 at the top feed point at −176° F. [−116° C.].

The further rectified vapor stream leaves the heat and mass transfer means in rectifying section 117*b* of processing assembly 117 at −182° F. [−119° C.] and enters the heat exchange means in cooling section 117*a* of processing assembly 117. The vapor is heated to −96° F. [−71° C.] as it provides cooling to streams 36*a* and 151*a* as described previously. The heated vapor is then discharged from processing assembly 117 as cool residue gas stream 153, which is heated and compressed as described previously for stream 39 in the FIG. 1 process.

A summary of stream flow rates and energy consumption for the process illustrated in FIG. 3 is set forth in the following table:

TABLE III (FIG. 3)
Stream Flow Summary - Lb. Moles/Hr [kg moles/Hr]

| Stream | Methane | Ethane | Propane | Butanes+ | Total |
|---|---|---|---|---|---|
| 31 | 17,272 | 2,734 | 1,070 | 657 | 21,961 |
| 32 | 15,276 | 1,676 | 359 | 76 | 17,604 |
| 33 | 1,996 | 1,058 | 711 | 581 | 4,357 |
| 34 | 3,247 | 356 | 76 | 16 | 3,742 |
| 35 | 499 | 264 | 178 | 145 | 1,089 |
| 36 | 3,746 | 620 | 254 | 161 | 4,831 |
| 37 | 12,029 | 1,320 | 283 | 60 | 13,862 |
| 38 | 1,497 | 794 | 533 | 436 | 3,268 |
| 39 | 17,608 | 179 | 3 | 0 | 18,020 |
| 151 | 1,610 | 16 | 0 | 0 | 1,647 |
| 152 | 15,998 | 163 | 3 | 0 | 16,373 |
| 154 | 373 | 144 | 3 | 0 | 521 |
| 155 | 4,119 | 764 | 254 | 161 | 5,352 |
| 153 | 17,235 | 35 | 0 | 0 | 17,499 |
| 42 | 37 | 2,699 | 1,070 | 657 | 4,462 |

Recoveries*

| | |
|---|---|
| Ethane | 98.70% |
| Propane | 100.00% |
| Butanes+ | 100.00% |

Power

| | | |
|---|---|---|
| Residue Gas Compression | 14,660 HP | [24,101 kW] |
| Refrigerant Compression | 3,733 HP | [6,137 kW] |
| Reflux Compression | 354 HP | [582 kW] |
| Total Compression | 18,747 HP | [30,820 kW] |

*(Based on un-rounded flow rates)

A comparison of Tables I and III shows that, compared to the FIG. 1 process, the FIG. 3 process improves ethane recovery from 96.69% to 98.70%, propane recovery from 99.84% to 100.00%, and butane+ recovery from 99.99% to 100.00%. Comparison of Tables I and III further shows that these increased product yields were achieved without using additional power.

Figure 4:
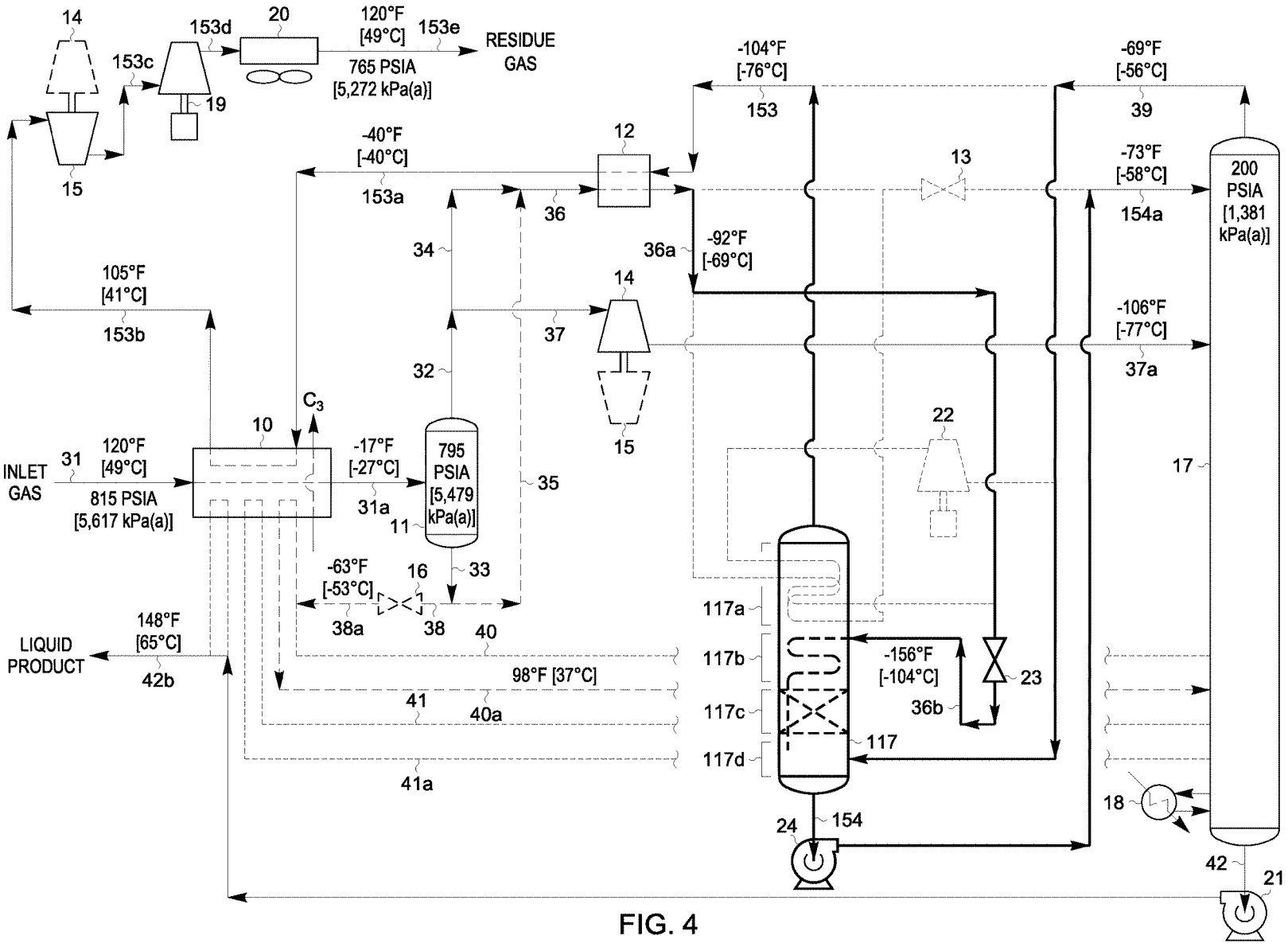

The process of co-pending application Ser. No. 15/332,723 can also be operated to reject nearly all of the $C_2$ components to the residue gas rather than recovering them in the liquid product. The operating conditions of the FIG. 3 process can be altered as illustrated in FIG. 4 (including the idling of the heat exchange means in cooling section 117*a* of processing assembly 117) to reduce the ethane content of the liquid product to the essentially the same level as that of the FIG. 2 process. The feed gas composition and conditions considered in the process presented in FIG. 4 are the same as those in FIG. 2. Accordingly, the FIG. 4 process can be compared with that of the FIG. 2 process.

Most of the process conditions shown for the FIG. 4 process are much the same as the corresponding process conditions for the FIG. 2 process. The main differences are again the disposition of substantially condensed stream 36*a* and column overhead vapor stream 39. In the FIG. 4 process, substantially condensed stream 36*a* is flash expanded through expansion valve 23 to slightly above the operating pressure (approximately 200 psia [1,381 kPa(a)]) of fractionation tower 17. During expansion a portion of the stream is vaporized, resulting in cooling of the total stream. In the process illustrated in FIG. 4, the expanded stream 36*b* leaving expansion valve 23 reaches a temperature of −156° F. [−104° C.] before it is directed into the heat and mass transfer means in rectifying section 117*b* of processing assembly 117.

The flash expanded stream 36*b* is further vaporized as it provides cooling and partial condensation of the combined vapor stream, and exits the heat and mass transfer means in rectifying section 117*b* at −83° F. [−64° C.]. The heated flash expanded stream discharges into separator section 117*d* of processing assembly 117 and is separated into its respective vapor and liquid phases. The vapor phase combines with overhead vapor stream 39 to form the combined vapor stream that enters the mass transfer means in absorbing section 117*c* as described previously, and the liquid phase combines with the condensed liquid from the bottom of the mass transfer means in absorbing section 117*c* to form combined liquid stream 154. Combined liquid stream 154 leaves the bottom of processing assembly 117 and is pumped to higher pressure by pump 24 so that stream 154*a* at −73° F. [−58° C.] can enter fractionation column 17 at the top feed point. The further rectified vapor stream leaves the heat and mass transfer means in rectifying section 117*b* and discharges from processing assembly 117 at −104° F. [−76° C.] as cold residue gas stream 153, which is then heated and compressed as described previously for stream 39 in the FIG. 2 process.

A summary of stream flow rates and energy consumption for the process illustrated in FIG. 4 is set forth in the following table:

TABLE IV (FIG. 4)
Stream Flow Summary - Lb. Moles/Hr [kg moles/Hr]

| Stream | Methane | Ethane | Propane | Butanes+ | Total |
|---|---|---|---|---|---|
| 31 | 17,272 | 2,734 | 1,070 | 657 | 21,961 |
| 32 | 15,902 | 1,943 | 474 | 112 | 18,652 |
| 33 | 1,370 | 791 | 596 | 545 | 3,309 |
| 34 | 3,263 | 399 | 97 | 23 | 3,827 |
| 35 | 507 | 293 | 221 | 202 | 1,224 |
| 36 | 3,770 | 692 | 318 | 225 | 5,051 |
| 37 | 12,639 | 1,544 | 377 | 89 | 14,825 |
| 38/40 | 863 | 498 | 375 | 343 | 2,085 |
| 39 | 13,802 | 2,765 | 294 | 16 | 17,061 |

TABLE IV-continued

| (FIG. 4) Stream Flow Summary - Lb. Moles/Hr [kg moles/Hr] | | | | | |
|---|---|---|---|---|---|
| 154 | 300 | 744 | 575 | 241 | 1,861 |
| 153 | 17,272 | 2,713 | 37 | 0 | 20,251 |
| 42 | 0 | 21 | 1,033 | 657 | 1,710 |

| Recoveries* | |
|---|---|
| Propane | 96.50% |
| Butanes+ | 100.00% |

| Power | | |
|---|---|---|
| Residue Gas Compression | 15,114 HP | [24,847 kW] |
| Refrigerant Compression | 3,621 HP | [5,953 kW] |
| Reflux Compression | 0 HP | [0 kW] |
| Total Compression | 18,735 HP | [30,800 kW] |

*(Based on un-rounded flow rates)

A comparison of Tables II and IV shows that, compared to the FIG. 2 process, the FIG. 4 process improves propane recovery from 89.20% to 96.50% and butane+ recovery from 98.81% to 100.00%. Comparison of Tables II and IV further shows that these increased product yields were achieved without using additional power.

DESCRIPTION OF THE INVENTION

Example 1

Figure 5:
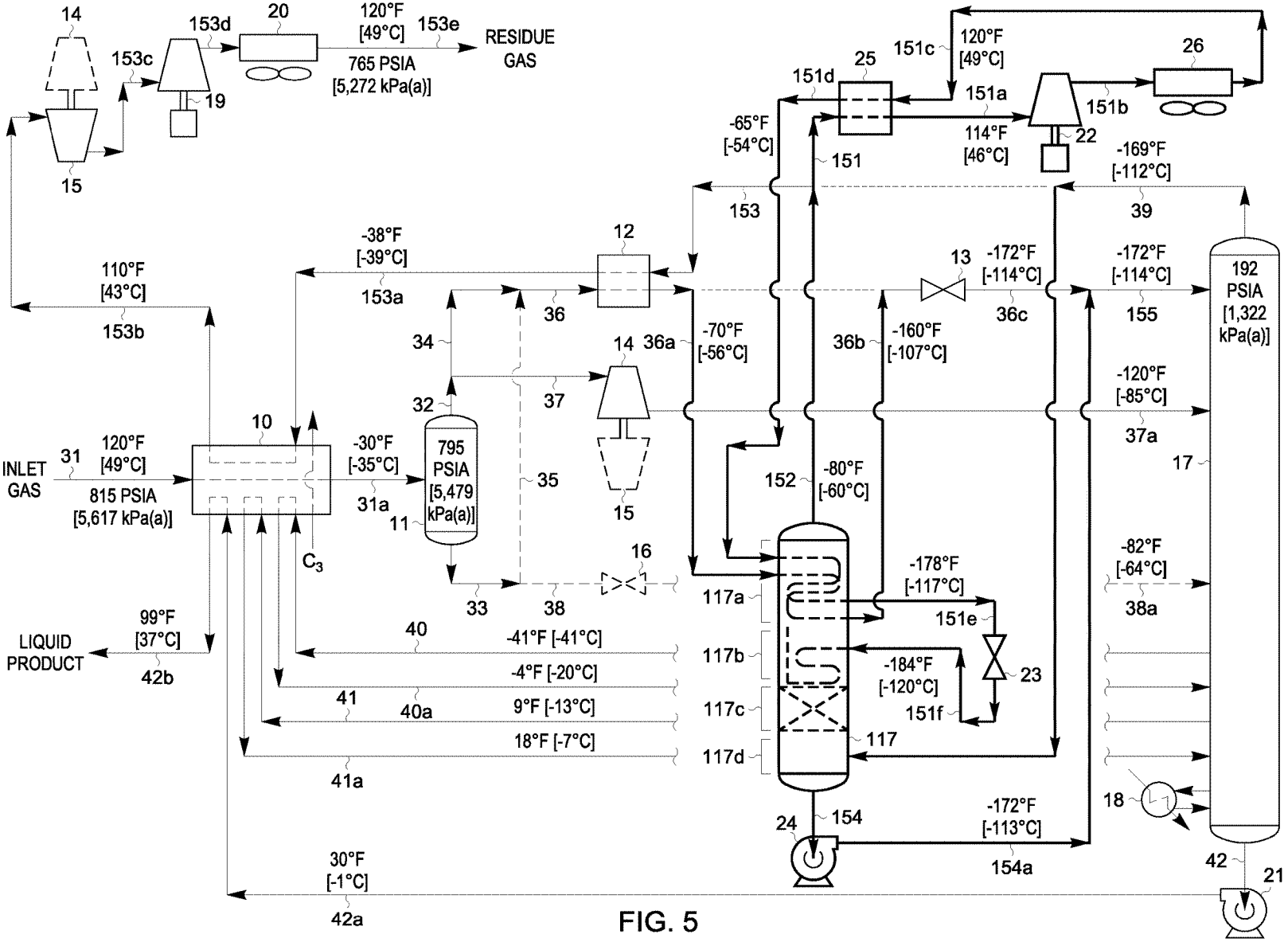
FIG. 5 is a flow diagram of a natural gas processing plant adapted to use the present invention.

In those cases where it is desirable to maximize the recovery of $C_2$ components in the liquid product (as in the FIG. 1 prior art process described previously, for instance), the present invention offers significant efficiency advantages over the prior art process depicted in FIG. 1 and the process of co-pending application Ser. No. 15/332,723 depicted in FIG. 3. FIG. 5 illustrates a flow diagram of the FIG. 1 prior art process that has been adapted to use the present invention. The operating conditions of the FIG. 5 process have been adjusted as shown to increase the ethane content of the liquid product above the level that is possible with the FIGS. 1 and 3 processes. The feed gas composition and conditions considered in the process presented in FIG. 5 are the same as those in FIGS. 1 and 3. Accordingly, the FIG. 5 process can be compared with that of the FIGS. 1 and 3 processes to illustrate the advantages of the present invention.

Most of the process conditions shown for the FIG. 5 process are much the same as the corresponding process conditions for the FIG. 1 process. The main difference is the disposition of partially condensed stream 36*a* and column overhead vapor stream 39. In the FIG. 5 process, column overhead vapor stream 39 at −169° F. [−112° C.] and 192 psia [1,322 kPa(a)] (the operating pressure of fractionation tower 17) is directed to separator section 117*d* inside single equipment item processing assembly 117. A heated combined stream 152 from cooling section 117*a* inside processing assembly 117 is divided into two streams, stream 153 and stream 151. Stream 151 is heated to 114° F. [46° C.] in heat exchanger 25 and then compressed to approximately 370 psia [2,549 kPa(a)] by reflux compressor 22. Compressed stream 151*b* is cooled to 120° F. [49° C.] (stream 151*c*) in discharge cooler 26, and then to −65° F. [−54° C.] (stream 151*d*) in heat exchanger 25 as it heats stream 151 as described previously. Cooled compressed stream 151*d* and partially condensed stream 36*a* at −70° F. [−56° C.] are then directed into a heat exchange means in cooling section 117*a* inside processing assembly 117. This heat exchange means may be comprised of a fin and tube type heat exchanger, a plate type heat exchanger, a brazed aluminum type heat exchanger, or other type of heat transfer device, including multi-pass and/or multi-service heat exchangers. The heat exchange means is configured to provide heat exchange between cooled compressed stream 151*d* flowing through one pass of the heat exchange means, partially condensed stream 36*a* flowing through another pass of the heat exchange means, and a combined stream arising from rectifying section 117*b* inside processing assembly 117, so that stream 151*d* is cooled to substantial condensation (stream 151*e*) and stream 36*a* is further cooled and substantially condensed (stream 36*b*) while heating the combined stream.

Absorbing section 117*c* inside processing assembly 117 contains a mass transfer means. This mass transfer means may consist of a plurality of vertically spaced trays, one or more packed beds, or some combination of trays and packing, but could also be comprised of a non-heat transfer zone in a fin and tube type heat exchanger, a plate type heat exchanger, a brazed aluminum type heat exchanger, or other type of heat transfer device, including multi-pass and/or multi-service heat exchangers. The mass transfer means is configured to provide contact between cold condensed liquid leaving the bottom of a heat and mass transfer means in rectifying section 117*b* inside processing assembly 117 and column overhead vapor stream 39 arising from separator section 117*d* inside processing assembly 117. As the column overhead vapor stream rises upward through absorbing section 117*c*, it is contacted with the cold liquid falling downward to condense and absorb $C_2$ components, $C_3$ components, and heavier components from the vapor stream. The resulting partially rectified vapor stream is then directed to the heat and mass transfer means in rectifying section 117*b* inside processing assembly 117 for further rectification.

Substantially condensed stream 151*e* at −178° F. [−117° C.] is flash expanded through expansion valve 23 to slightly above the operating pressure of fractionation tower 17. During expansion a portion of the stream may be vaporized, resulting in cooling of the total stream. In the process illustrated in FIG. 5, the expanded stream 151*f* leaving expansion valve 23 reaches a temperature of −184° F. [−120° C.] before it is directed into the heat and mass transfer means in rectifying section 117*b* inside processing assembly 117. This heat and mass transfer means may also be comprised of a fin and tube type heat exchanger, a plate type heat exchanger, a brazed aluminum type heat exchanger, or other type of heat transfer device, including multi-pass and/or multi-service heat exchangers. The heat and mass transfer means is configured to provide heat exchange between the partially rectified vapor stream arising from absorbing section 117*c* inside processing assembly 117 that is flowing upward through one pass of the heat and mass transfer means, and the flash expanded substantially condensed stream 151*f* flowing downward, so that the partially rectified vapor stream is cooled while heating the expanded stream. As the partially rectified vapor stream is cooled, a portion of it is condensed and falls downward while the remaining vapor continues flowing upward through the heat and mass transfer means. The heat and mass transfer means provides continuous contact between the condensed liquid and the partially rectified vapor stream so that it also functions to provide mass transfer between the vapor and liquid phases, thereby providing further rectification of the partially rectified vapor stream to form a further rectified vapor stream. The condensed liquid from the bottom of the heat and mass transfer means is directed to absorbing section 117*c* inside processing assembly 117.

The flash expanded stream 151*f* is further vaporized as it provides cooling and partial condensation of the partially rectified vapor stream, and exits the heat and mass transfer means in rectifying section 117*b* inside processing assembly 117 at −182° F. [−119° C.]. The heated flash expanded stream then mixes with the further rectified vapor stream to form a combined stream at −181° F. [−119° C.] that is directed to the heat exchange means in cooling section 117*a* inside processing assembly 117. The combined stream is heated as it provides cooling to streams 151*d* and 36*a* as described previously.

The distillation liquid leaving the bottom of the mass transfer means in absorbing section 117*c* discharges from the bottom of processing assembly 117 (stream 154) and is pumped to higher pressure by pump 24 (stream 154*a* at −172° F. [−113° C.]). Further cooled substantially condensed stream 36*b* at −160° F. [−107° C.] is flash expanded through expansion valve 13 to the operating pressure of fractionation tower 17. During expansion a portion of the stream may be vaporized, resulting in cooling of the total stream to −172° F. [−114° C.]. Flash expanded stream 36*c* then joins with pumped stream 154*a* to form combined feed stream 155, which enters fractionation column 17 at the top feed point at −172° F. [−114° C.].

The heated combined stream 152 is discharged from the heat exchange means in cooling section 117*a* inside processing assembly 117 at −80° F. [−62° C.]. It is divided into the previously described stream 151, and into cool residue gas stream 153 which is then heated and compressed as described previously for stream 39 in the FIG. 1 process.

A summary of stream flow rates and energy consumption for the process illustrated in FIG. 5 is set forth in the following table:

TABLE V (FIG. 5)
Stream Flow Summary - Lb. Moles/Hr [kg moles/Hr]

| Stream | Methane | Ethane | Propane | Butanes+ | Total |
|---|---|---|---|---|---|
| 31 | 17,272 | 2,734 | 1,070 | 657 | 21,961 |
| 32 | 15,233 | 1,659 | 353 | 74 | 17,537 |
| 33 | 2,039 | 1,075 | 717 | 583 | 4,424 |
| 34 | 3,961 | 431 | 92 | 19 | 4,560 |
| 35 | 510 | 269 | 179 | 146 | 1,106 |
| 36 | 4,471 | 700 | 271 | 165 | 5,666 |
| 37 | 11,272 | 1,228 | 261 | 55 | 12,977 |
| 38 | 1,529 | 806 | 538 | 437 | 3,318 |
| 39 | 17,702 | 107 | 3 | 0 | 18,041 |
| 152 | 18,860 | 12 | 0 | 0 | 19,121 |
| 151 | 1,625 | 1 | 0 | 0 | 1,647 |
| 154 | 467 | 96 | 3 | 0 | 567 |
| 155 | 4,938 | 796 | 273 | 165 | 6,233 |
| 153 | 17,235 | 11 | 0 | 0 | 17,474 |
| 42 | 37 | 2,723 | 1,070 | 657 | 4,487 |

Recoveries*

| | |
|---|---|
| Ethane | 99.60% |
| Propane | 100.00% |
| Butanes+ | 100.00% |

Power

| | | |
|---|---|---|
| Residue Gas Compression | 14,093 HP | [23,169 kW] |
| Refrigerant Compression | 3,916 HP | [6,438 kW] |
| Reflux Compression | 736 HP | [1,210 kW] |
| Total Compression | 18,745 HP | [30,817 kW] |

*(Based on un-rounded flow rates)

A comparison of Tables I and V shows that, compared to the prior art of FIG. 1, the present invention improves ethane recovery from 96.69% to 99.60%, propane recovery from 99.84% to 100.00%, and butane+ recovery from 99.99% to 100.00%. The economic impact of these improved recoveries is significant. Using an average incremental value $0.10/gallon [€21.9/m$^3$] for hydrocarbon liquids compared to the corresponding hydrocarbon gases, the improved recoveries represent more than US$710,000 [€590,000] of additional annual revenue for the plant operator. Comparison of Tables III and V shows that the present invention is also an improvement over co-pending application Ser. No. 15/332,723, increasing the ethane recovery from 98.70% to 99.60%. Comparison of Tables I, III, and V further shows that these increased product yields were achieved using essentially the same power as the FIGS. 1 and 3 processes. In terms of the recovery efficiency (defined by the quantity of $C_2$ components and heavier components recovered per unit of power), the present invention represents more than a 1% improvement over the prior art of the FIG. 1.

The improvement in recovery efficiency provided by the present invention over that of the prior art of the FIG. 1 process is primarily due to the supplemental indirect cooling of the column overhead vapor provided by flash expanded stream 151*f* in rectifying section 117*b* inside processing assembly 117, in addition to the direct-contact cooling provided by stream 36*b* in the prior art process of FIG. 1. Although stream 36*b* is quite cold, it is not an ideal reflux stream because it contains significant concentrations of the $C_2$ components, $C_3$ components, and $C_4$+ components that demethanizer 17 is supposed to capture, resulting in losses of these desirable components due to equilibrium effects at the top of column 17 for the prior art process of FIG. 1. For the present invention shown in FIG. 5, however, the supplemental cooling provided by flash expanded stream 151*f* has no equilibrium effects to overcome because there is no direct contact between flash expanded stream 151*f* and the column overhead vapor stream to be rectified.

The present invention has the further advantage of using the heat and mass transfer means in rectifying section 117*b* to simultaneously cool the column overhead vapor stream and condense the heavier hydrocarbon components from it, providing more efficient rectification than using reflux in a conventional distillation column. As a result, more of the $C_2$ components, $C_3$ components, and heavier hydrocarbon components can be removed from the column overhead vapor stream using the refrigeration available in flash expanded stream 151*f* than is possible using conventional mass transfer equipment and conventional heat transfer equipment.

The present invention offers two other advantages over the prior art in addition to the increase in processing efficiency. First, the compact arrangement of processing assembly 117 of the present invention incorporates what would normally be three separate equipment items (the heat exchange means in cooling section 117*a*, the heat and mass transfer means in rectifying section 117*b*, and the mass transfer means in absorbing section 117*c*) into a single equipment item (processing assembly 117 in FIG. 5 of the present invention). This reduces the plot space requirements and eliminates the interconnecting piping, reducing the capital cost of modifying a processing plant to use the present invention. Second, elimination of the interconnecting piping means that a processing plant modified to use the present invention has far fewer flanged connections, reducing the number of potential leak sources in the plant. Hydrocarbons are volatile organic compounds (VOCs), some of which are classified as greenhouse gases and some of which may be precursors to atmospheric ozone formation, which means the present invention reduces the potential for atmospheric releases that may damage the environment.

One additional advantage of the present invention is how easily it can be incorporated into an existing gas processing plant to effect the superior performance described above. As shown in FIG. 5, only three connections (commonly referred to as "tie-ins") to the existing plant are needed: for partially condensed stream 36*a* (represented by the dashed line between stream 36*a* and stream 36*b* that is removed from service), for column feed line 155 (represented by the connection with stream 154*a*), and for column overhead vapor stream 39 (represented by the dashed line between stream 39 and stream 152 that is removed from service). The existing plant can continue to operate while the new processing assembly 117 is installed near fractionation tower 17, with just a short plant shutdown when installation is complete to make the new tie-ins to these three existing lines. The plant can then be restarted, with all of the existing equipment remaining in service and operating exactly as before, except that the product recovery is now higher with no increase in compression power.

The main reason the present invention is more efficient than our co-pending application Ser. No. 15/332,723 depicted in FIG. 3 is that it removes nearly all of the heat of compression added by reflux compressor 22 via discharge cooler 26. In the FIG. 3 process, compressor discharge stream 151*a* is much hotter than compressor suction stream 151 (−81° F. [−63° C.] for stream 151*a* versus −167° F. [−110° C.] for stream 151). This additional heat in the compressed stream must be removed in cooling section 117*a* of processing assembly in the FIG. 3 process, meaning less cooling is available for streams 36*a* and 151*a*. Contrast this with the FIG. 5 embodiment of the present invention, where the cooled compressed stream 151*d* is nearly the same temperature as compressor suction stream 151 (−65° F. [−54° C.] for stream 151*d* versus −80° F. [−60° C.] for stream 151). This means more cooling is available in cooling section 117*a* inside processing assembly 117 of the present invention, which in turn allows more reflux flow to the top of demethanizer 17 (16% higher flow for stream 155 in FIG. 5 compared to stream 155 in FIG. 3).

Example 2

Figure 6:
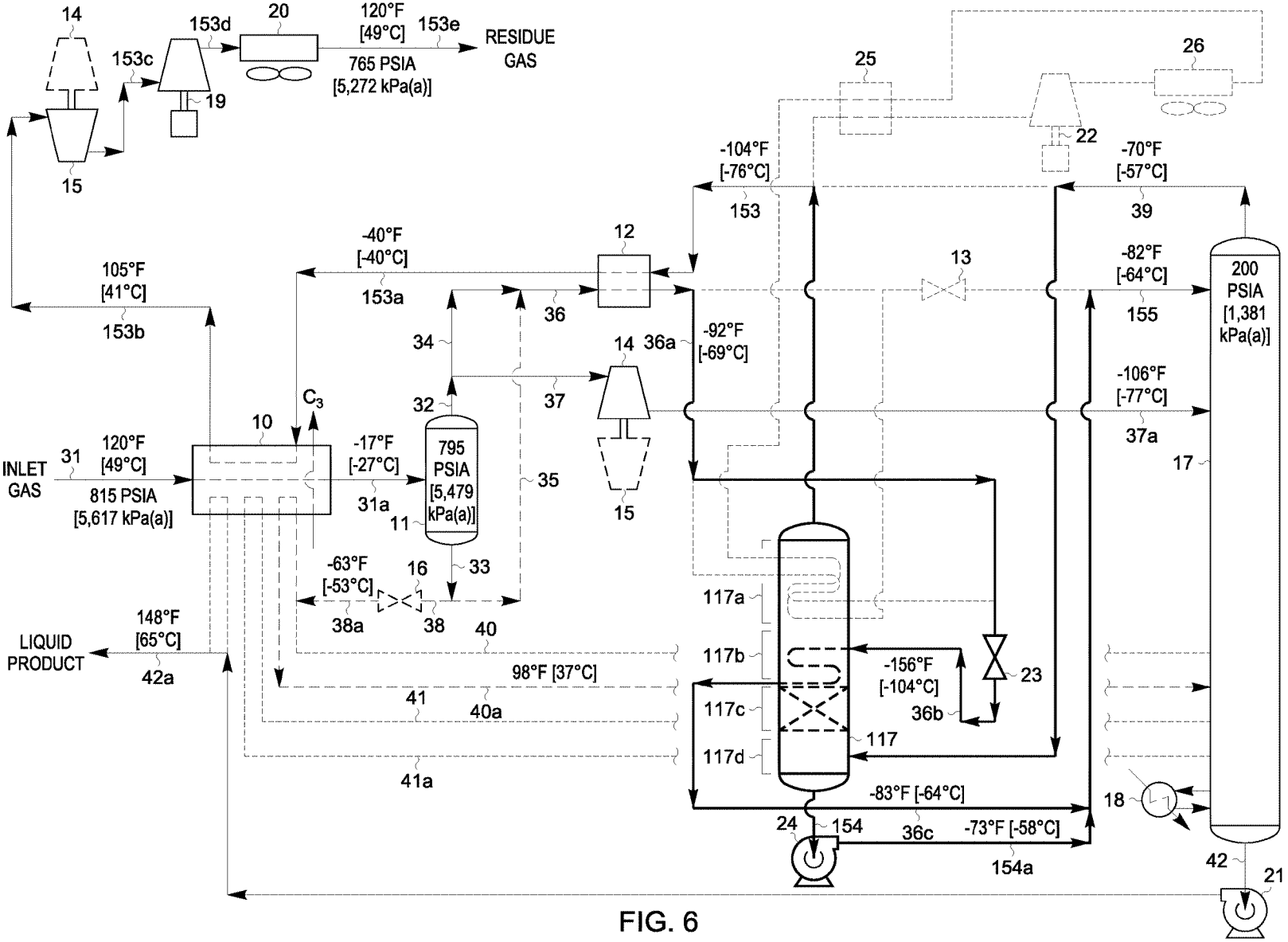
FIGS. 6 through 17 are flow diagrams illustrating alternative means of application of the present invention to a natural gas processing plant.

The present invention also offers advantages when product economics favor rejecting the $C_2$ components to the residue gas product. The present invention can be easily reconfigured to operate in a manner similar to that of our U.S. Pat. Nos. 9,637,428 and 9,927,171 as shown in FIG. 6. The operating conditions of the FIG. 5 embodiment of the present invention can be altered as illustrated in FIG. 6 to reduce the ethane content of the liquid product to the same level as that of the FIG. 2 prior art process and of co-pending application Ser. No. 15/332,723 depicted in FIG. 4. The feed gas composition and conditions considered in the process presented in FIG. 6 are the same as those in FIGS. 2 and 4. Accordingly, the FIG. 6 process can be compared with that of the FIGS. 2 and 4 processes to further illustrate the advantages of the present invention.

When operating the present invention in this manner, many of the process conditions shown for the FIG. 6 process are much the same as the corresponding process conditions for the FIG. 2 process, although most of the process configuration is like the FIG. 5 embodiment of the present invention. The main difference relative to the FIG. 5 embodiment is that the flash expanded stream 36*b* directed to the heat and mass transfer means in rectifying section 117*b* inside processing assembly 117 for FIG. 6 originates from substantially condensed stream 36*a*, rather than from heated combined stream 152 as in FIG. 5. As such, reflux compressor 22 and its associated equipment are not needed and can be taken out of service (as indicated by the dashed lines), eliminating the power consumption of this compressor when operating in this manner.

For the operating conditions shown in FIG. 6, combined stream 36 is cooled to −92° F. [−69° C.] in heat exchanger 12 by heat exchange with cool residue gas stream 153. The substantially condensed stream 36*a* is flash expanded through expansion valve 23 to slightly above the operating pressure (approximately 200 psia [1,381 kPa(a)]) of fractionation tower 17. During expansion a portion of the stream may be vaporized, resulting in cooling of the total stream. In the process illustrated in FIG. 6, the expanded stream 36*b* leaving expansion valve 23 reaches a temperature of −156° F. [−104° C.] before it is directed into the heat and mass transfer means in rectifying section 117*b* inside processing assembly 117.

The flash expanded stream 36*b* is further vaporized as it provides cooling and partial condensation of the partially rectified vapor stream, and exits the heat and mass transfer means in rectifying section 117*b* inside processing assembly 117 at −83° F. [−64° C.]. The heated flash expanded stream 36*c* is then mixed with pumped liquid stream 154*a* to form combined feed stream 155, which enters fractionation column 17 at the top feed point at −82° F. [−64° C.].

The further rectified vapor stream leaves the heat and mass transfer means in rectifying section 117*b* inside processing assembly 117 at −104° F. [−76° C.]. Since the heat exchange means in cooling section 117*a* inside processing assembly 117 has been idled, the vapor simply discharges from processing assembly 117 as cool residue gas stream 153, which is heated and compressed as described previously for stream 39 in the FIG. 2 process.

A summary of stream flow rates and energy consumption for the process illustrated in FIG. 6 is set forth in the following table:

TABLE VI (FIG. 6)
Stream Flow Summary - Lb. Moles/Hr [kg moles/Hr]

| Stream | Methane | Ethane | Propane | Butanes+ | Total |
|---|---|---|---|---|---|
| 31 | 17,272 | 2,734 | 1,070 | 657 | 21,961 |
| 32 | 15,902 | 1,943 | 474 | 112 | 18,652 |
| 33 | 1,370 | 791 | 596 | 545 | 3,309 |
| 34 | 3,263 | 399 | 97 | 23 | 3,827 |
| 35 | 507 | 293 | 221 | 202 | 1,224 |
| 36 | 3,770 | 692 | 318 | 225 | 5,051 |
| 37 | 12,639 | 1,544 | 377 | 89 | 14,825 |
| 38/40 | 863 | 498 | 375 | 343 | 2,085 |
| 39 | 13,802 | 2,765 | 294 | 16 | 17,061 |
| 154 | 300 | 744 | 575 | 241 | 1,861 |
| 155 | 4,070 | 1,436 | 893 | 466 | 6,912 |
| 153 | 17,272 | 2,713 | 37 | 0 | 20,251 |
| 42 | 0 | 21 | 1,033 | 657 | 1,710 |

Recoveries*

| | |
|---|---|
| Propane | 96.50% |
| Butanes+ | 100.00% |

Power

| | | |
|---|---|---|
| Residue Gas Compression | 15,114 HP | [24,847 kW] |
| Refrigerant Compression | 3,621 HP | [5,953 kW] |
| Reflux Compression | 0 HP | [0 kW] |
| Total Compression | 18,735 HP | [30,800 kW] |

*(Based on un-rounded flow rates)

A comparison of Tables II and VI shows that, compared to the prior art, the FIG. 6 process improves propane recovery from 89.20% to 96.50% and butane+ recovery from 98.81% to 100.00%. Comparison of Tables II and VI further shows that these increased product yields were achieved without using additional power. The economic impact of these improved recoveries is substantial. Using an average incremental value $0.58/gallon [€129/m$^3$] for hydrocarbon liquids compared to the corresponding hydrocarbon gases, the improved recoveries represent more than US$4,720,000 [€3,930,000] of additional annual revenue for the plant operator. A comparison of Tables IV and VI shows that the FIG. 6 process has essentially the same performance as co-pending application Ser. No. 15/332,723 when rejecting $C_2$ components to the residue gas product.

Other Embodiments

Figure 7:
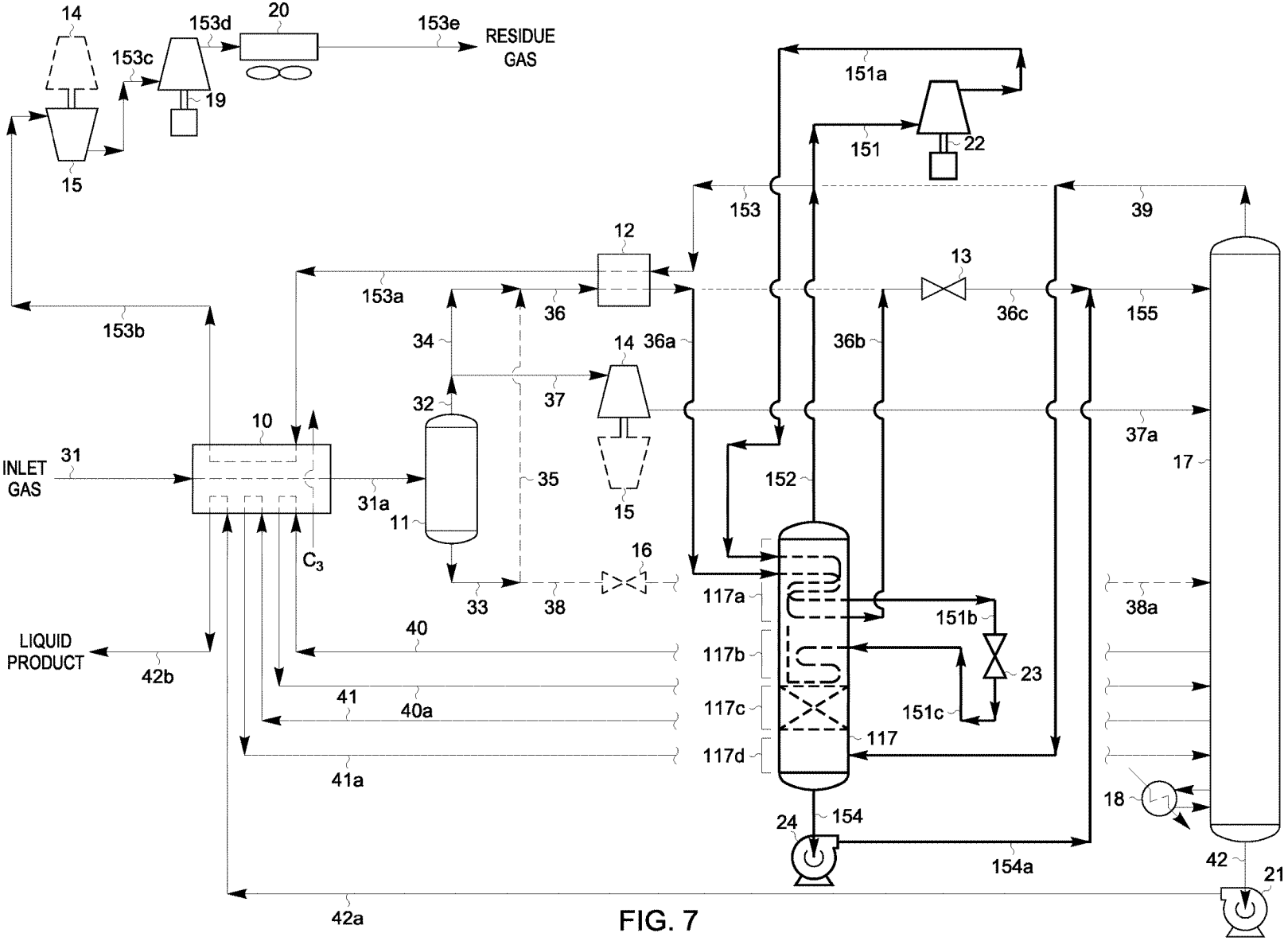
Figure 8:
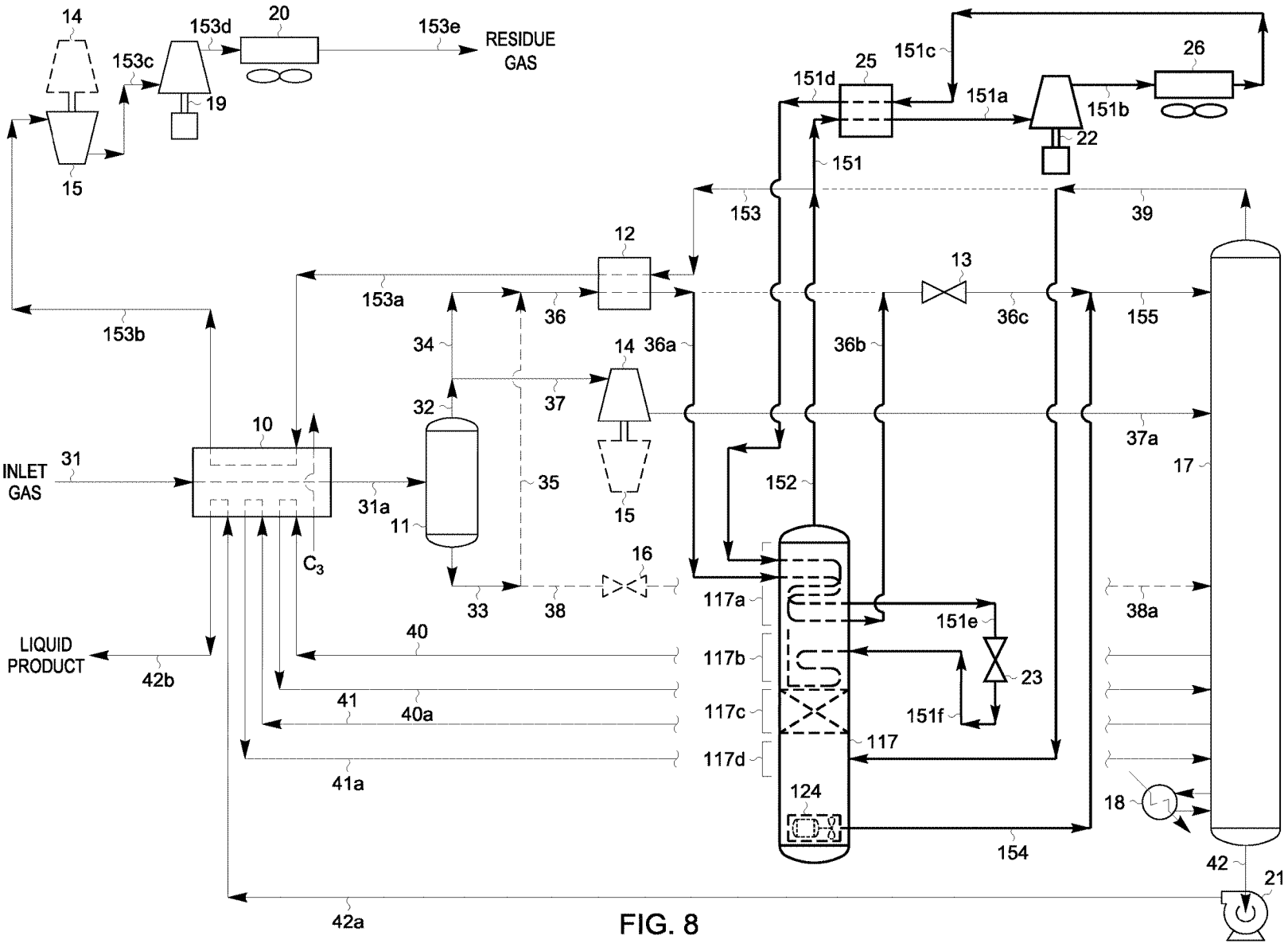
Figure 9:
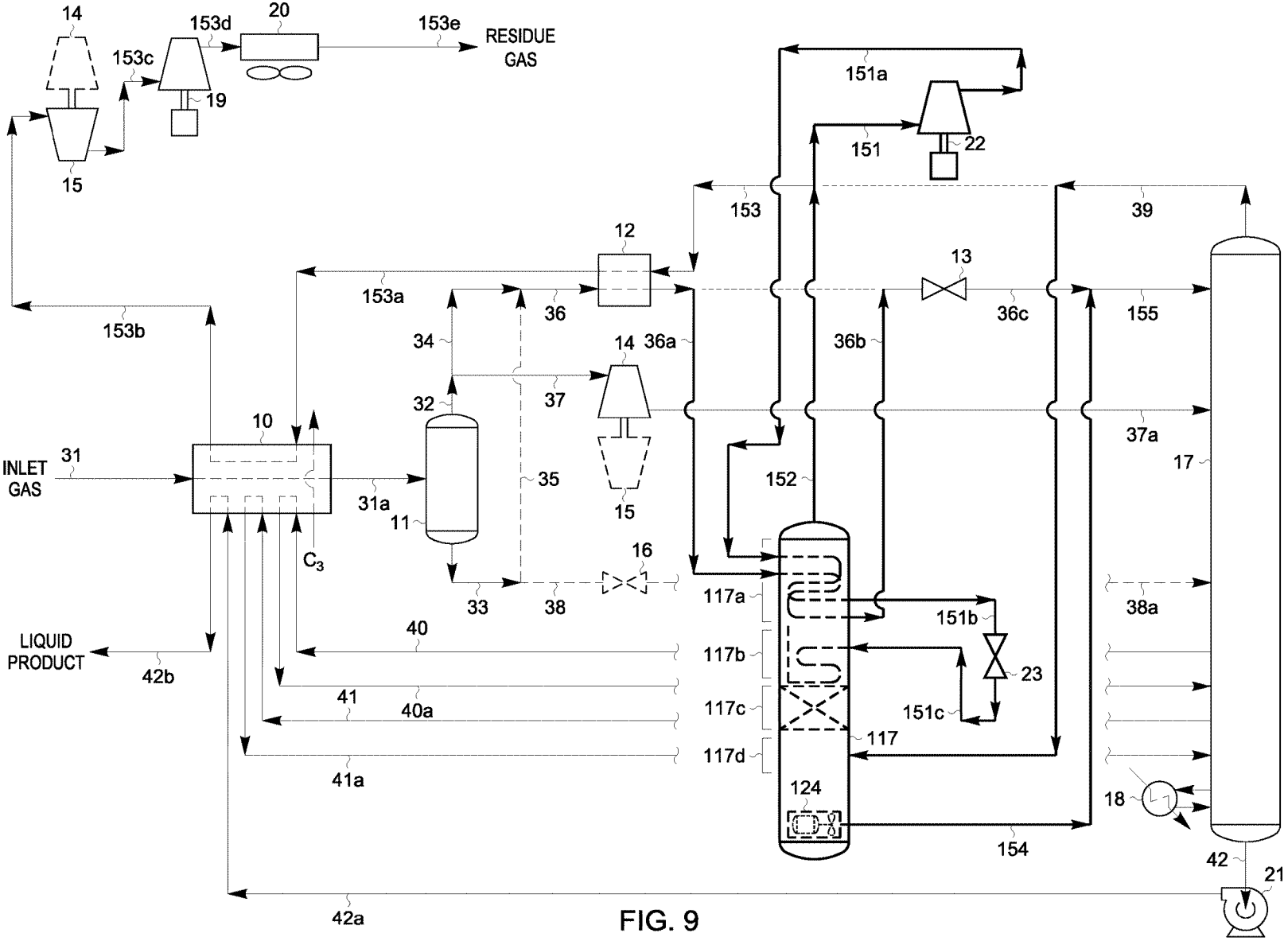
Figure 10:
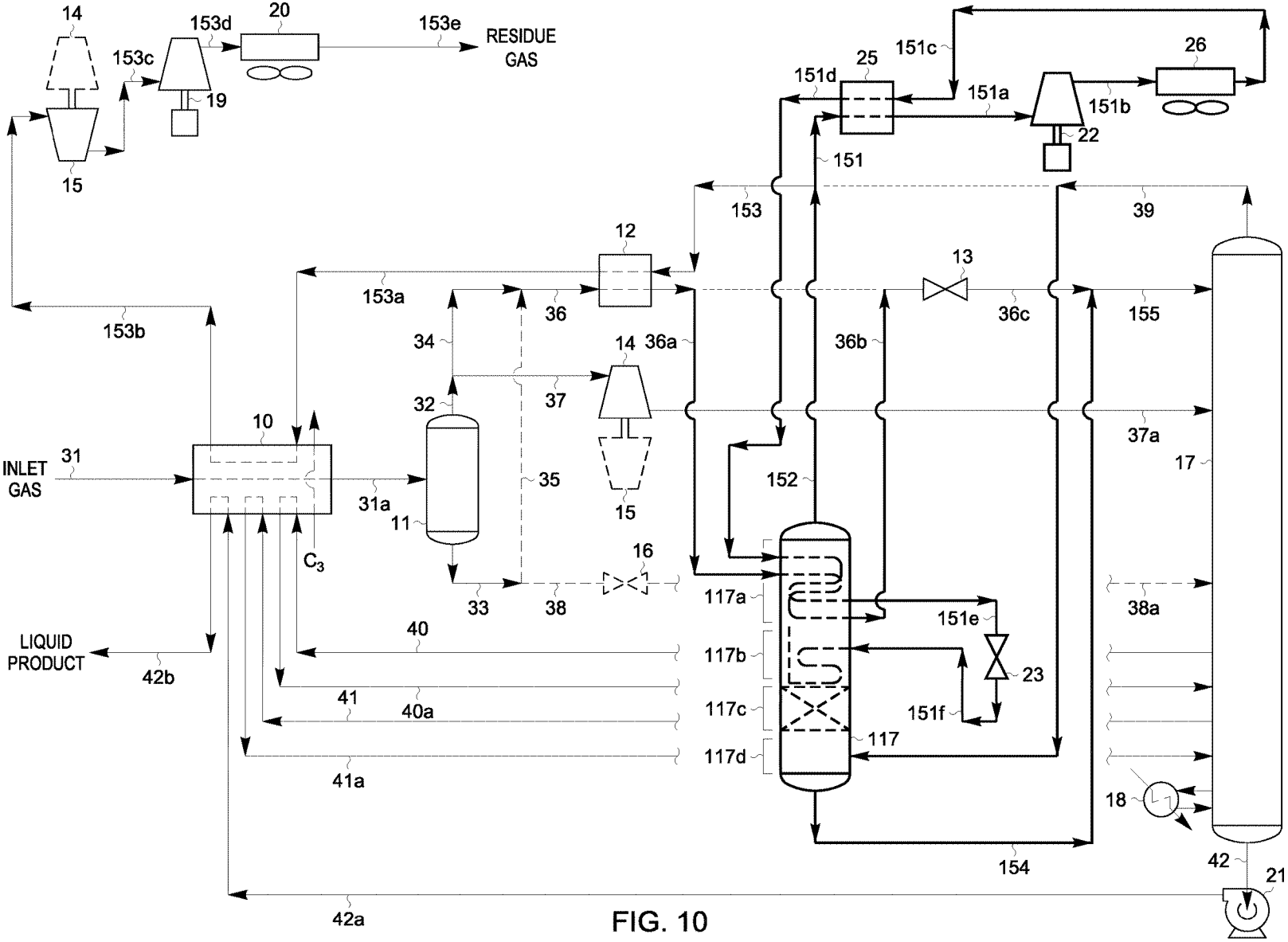
Figure 11:
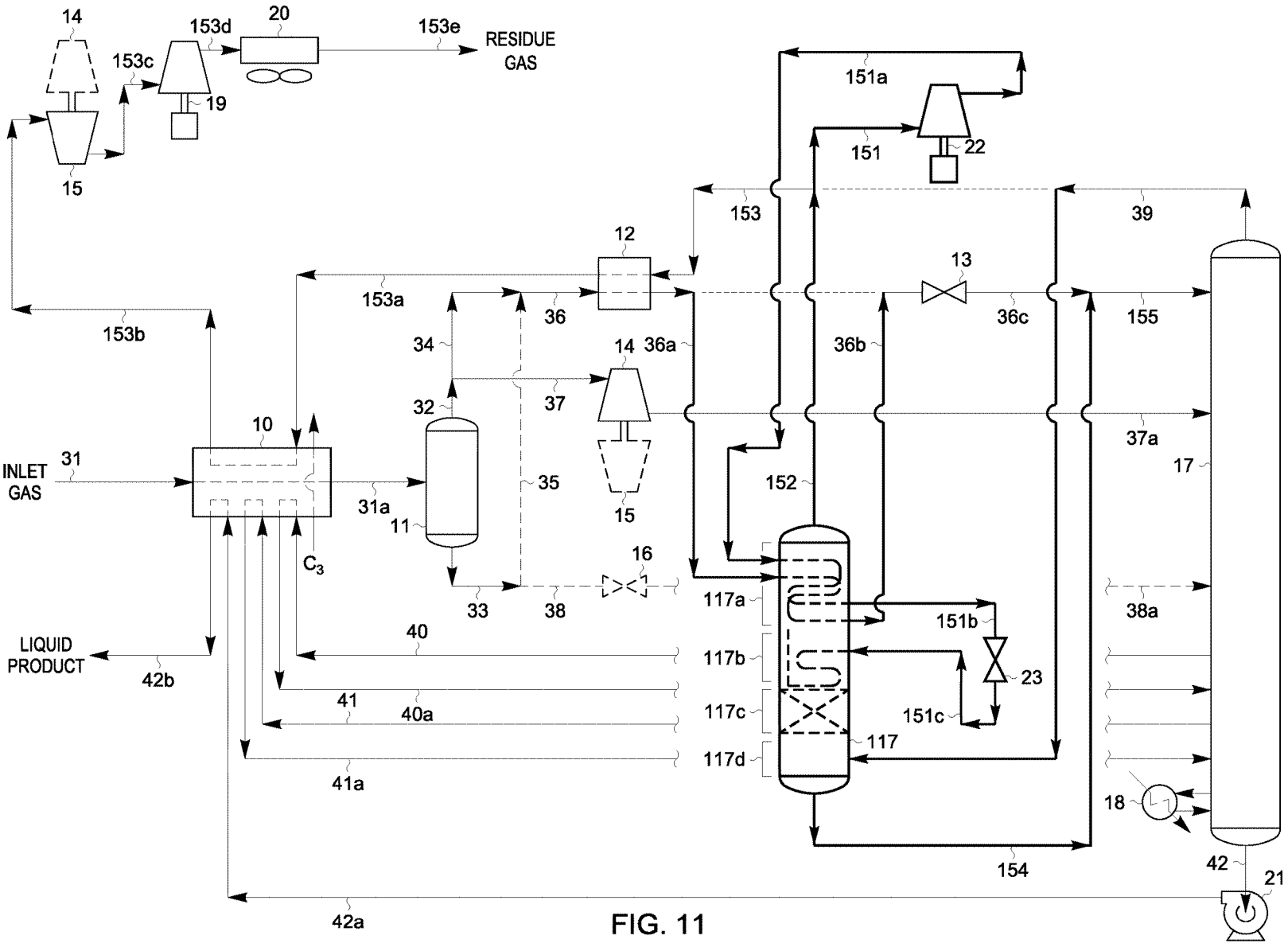
Figure 12:
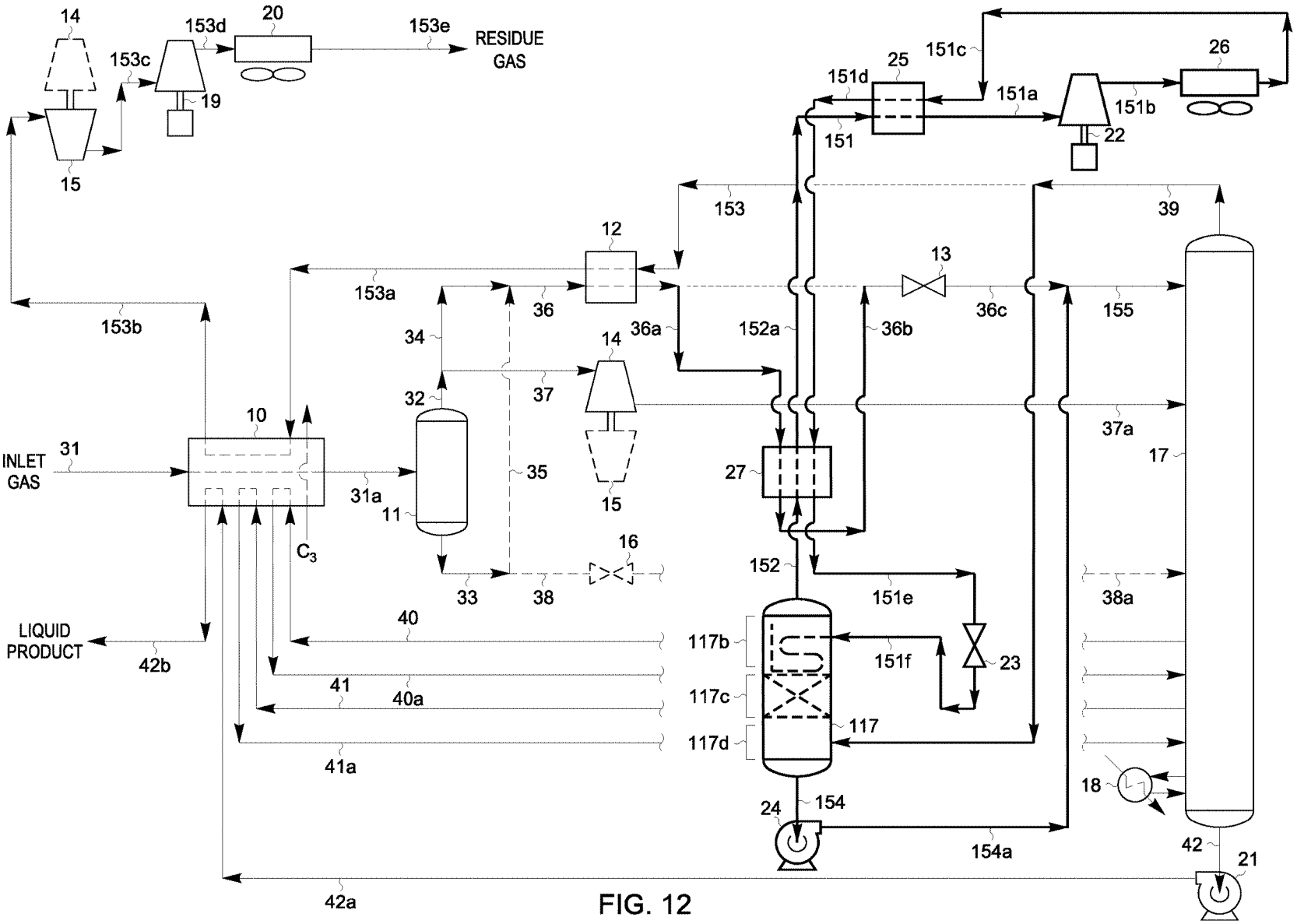
Figure 13:
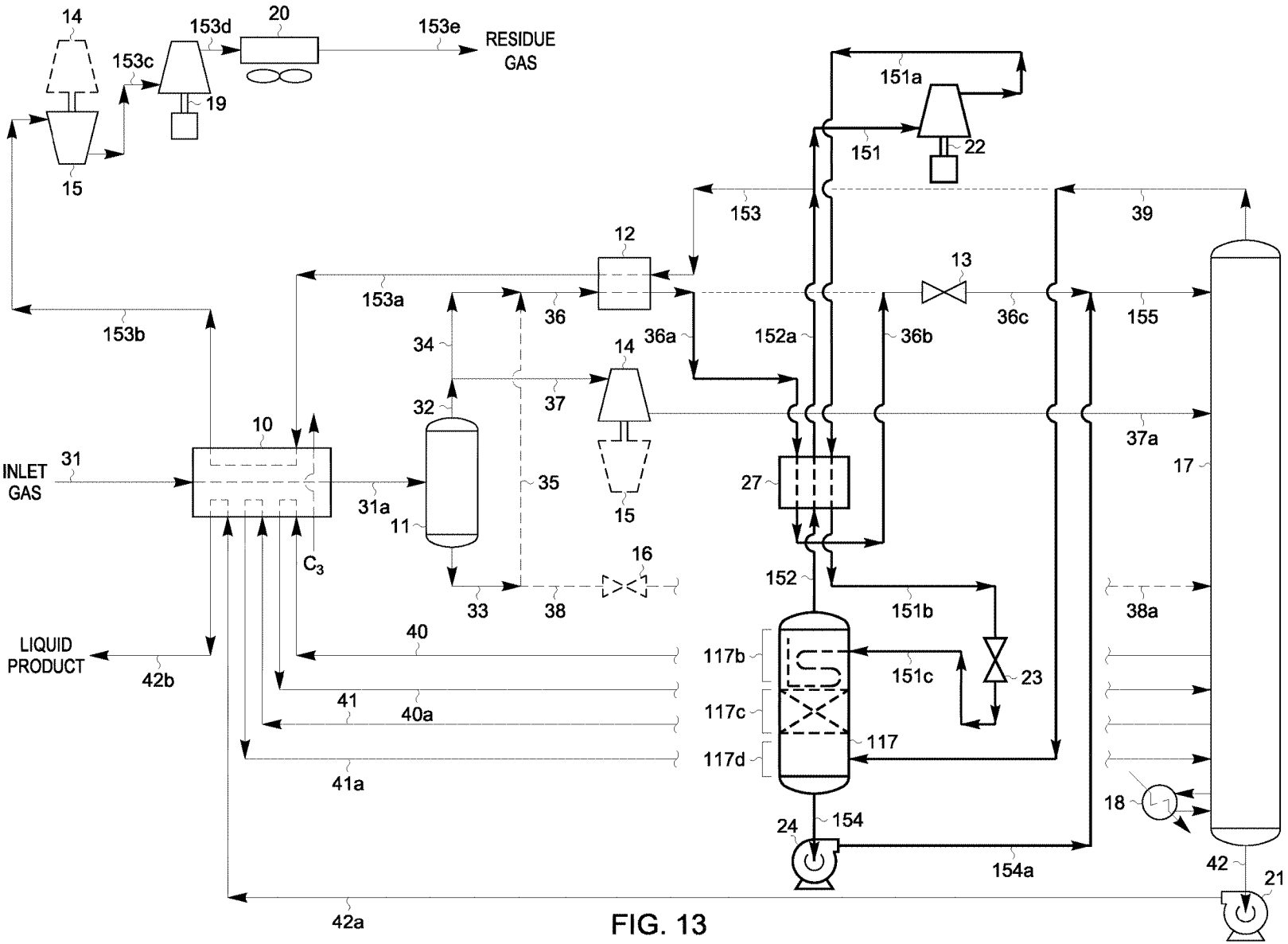
Figure 14:
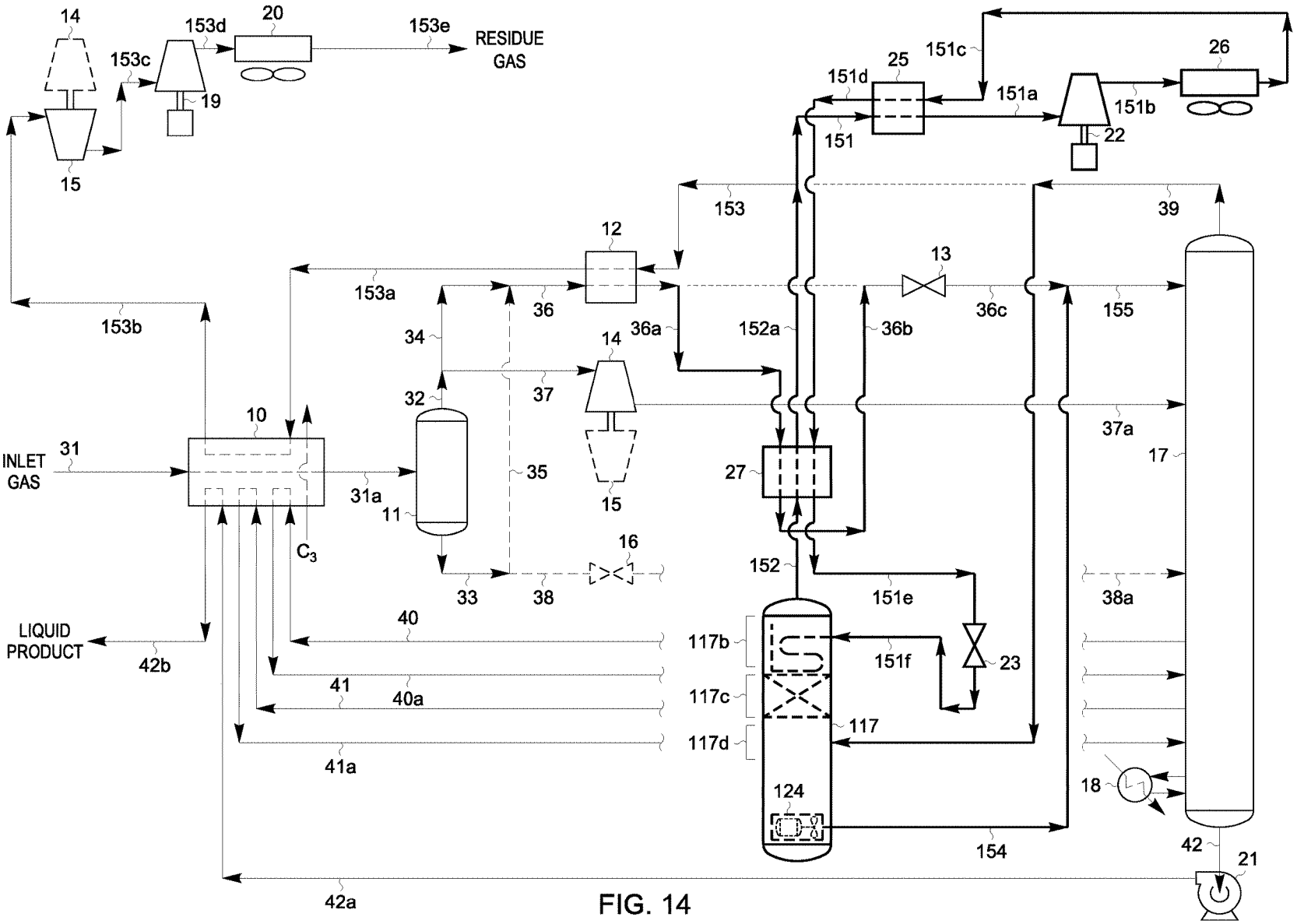
Figure 15:
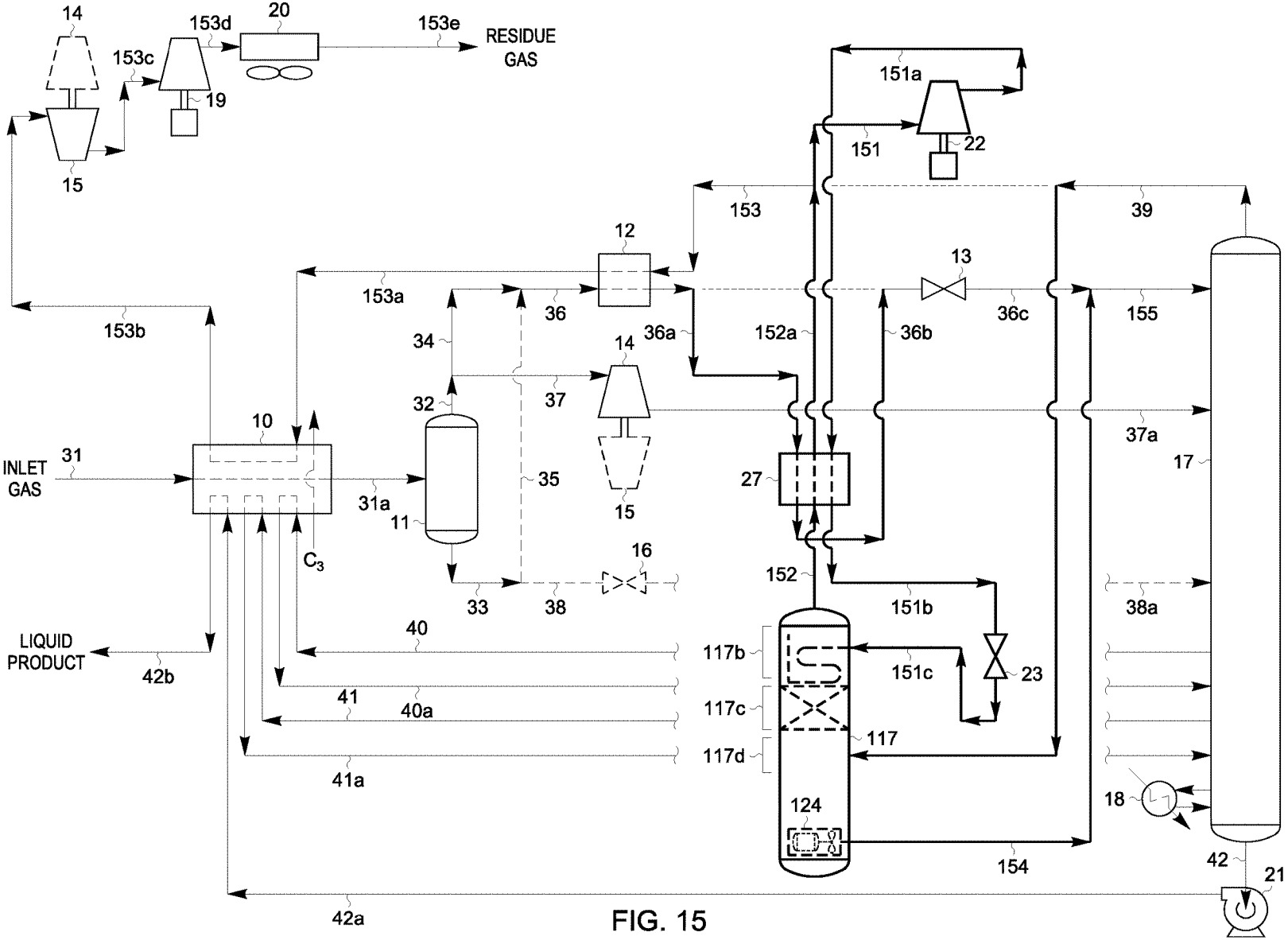
Figure 16:
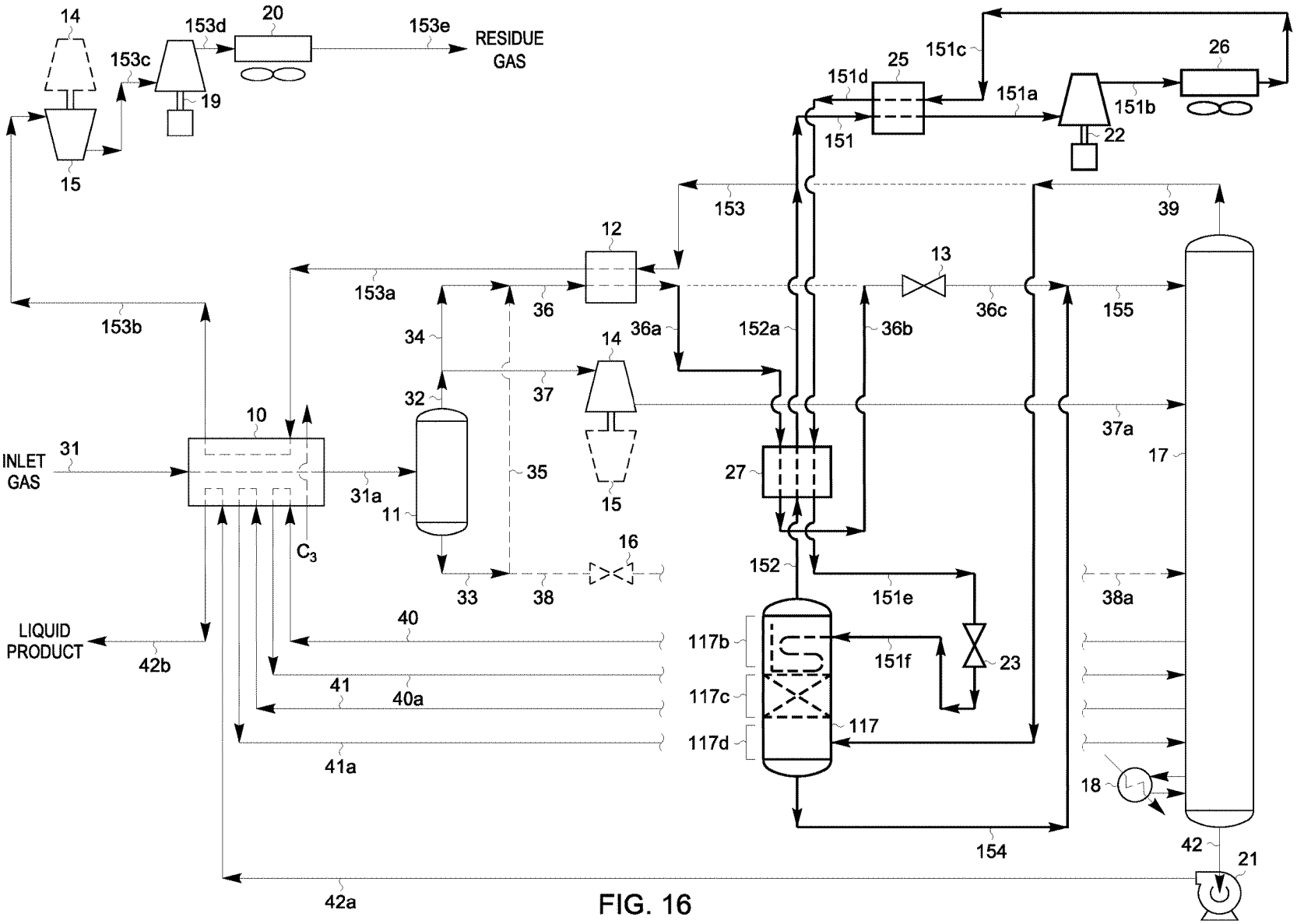
Figure 17:
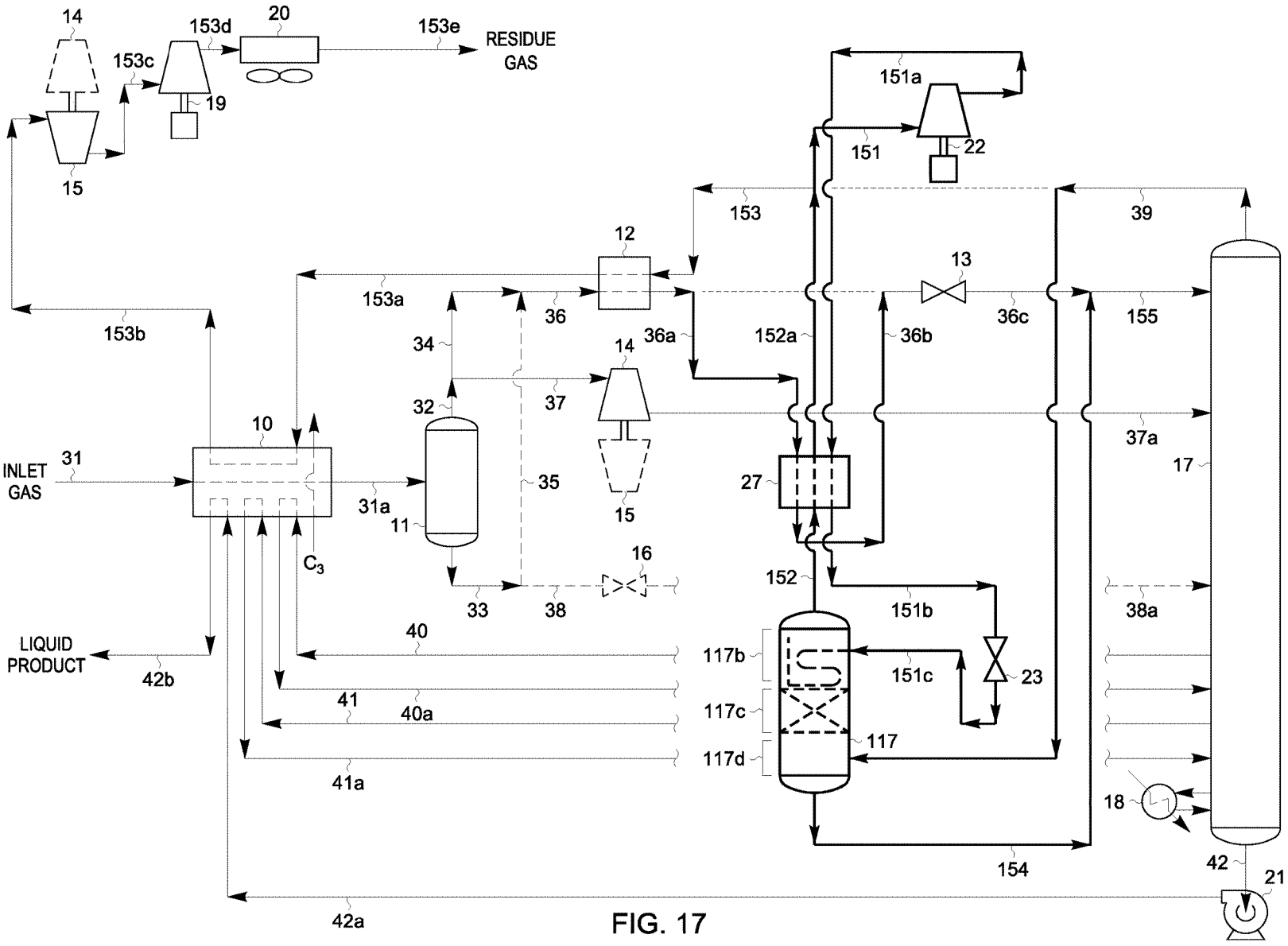

In the embodiment of the present invention shown in FIG. 5, heat exchanger 25 and discharge cooler 26 are used to remove the heat of compression produced in reflux compressor 22. Some applications may favor eliminating this capital expense by supplying compressor discharge stream 151*a* directly to the heat exchange means in cooling section 117*a* inside processing assembly 117 as shown in FIG. 7. The choice of which embodiment is best for a given application will generally depend on factors such as plant size and the cost of heat exchange equipment.

Some circumstances may favor mounting the liquid pump inside the processing assembly to further reduce the number of equipment items and the plot space requirements. Such embodiments are shown in FIGS. 8, 9, 14, and 15, with pump 124 mounted inside processing assembly 117 as shown to send the distillation liquid stream from separator section 117*d* via conduit 154 to combine with stream 36*c* and form combined feed stream 155 that is supplied as the top feed to column 17. The pump and its driver may both be mounted inside the processing assembly if a submerged pump or canned motor pump is used, or just the pump itself may be mounted inside the processing assembly (using a magnetically-coupled drive for the pump, for instance). For either option, the potential for atmospheric releases of hydrocarbons that may damage the environment is reduced still further.

Some circumstances may favor locating the processing assembly at a higher elevation than the top feed point on fractionation column 17. In such cases, it may be possible for distillation liquid stream 154 to flow by gravity head and combine with stream 36*c* so that the resulting combined feed stream 155 then flows to the top feed point on fractionation column 17 as shown in FIGS. 10, 11, 16, and 17, eliminating the need for pump 24/124 shown in the FIGS. 5 through 9 and 12 through 15 embodiments.

Some circumstances may favor eliminating cooling section 117*a* from processing assembly 117, and using a heat exchange means external to the processing assembly for feed cooling, such as heat exchanger 27 shown in FIGS. 12 through 17. Such an arrangement allows processing assembly 117 to be smaller, which may reduce the overall plant cost and/or shorten the fabrication schedule in some cases. Note that in all cases exchanger 27 is representative of either a multitude of individual heat exchangers or a single multi-pass heat exchanger, or any combination thereof. Each such heat exchanger may be comprised of a fin and tube type heat exchanger, a plate type heat exchanger, a brazed aluminum type heat exchanger, or other type of heat transfer device, including multi-pass and/or multi-service heat exchangers.

The present invention provides improved recovery of $C_2$ components, $C_3$ components, and heavier hydrocarbon components per amount of utility consumption required to operate the process. An improvement in utility consumption required for operating the process may appear in the form of reduced power requirements for compression or re-compression, reduced power requirements for external refrigeration, reduced energy requirements for supplemental heating, or a combination thereof.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. An apparatus for the separation of a gas stream, containing methane, $C_2$ components, $C_3$ components, and heavier hydrocarbon component into a volatile residue gas fraction and a relatively less volatile fraction containing a major portion of said $C_2$ components, $C_3$ components, and heavier hydrocarbon components or said $C_3$ components and heavier hydrocarbon components, said apparatus comprising (a) a first cooling device to cool said gas stream under pressure to produce a cooled gas stream;

(b) a first divider connected to said first cooling device to receive and divide said cooled gas stream into a cooled first stream and a cooled second stream;

(c) a second cooling device connected to said first divider to receive and further cool said cooled first stream under pressure to produce an at least partially condensed first stream;

(d) a first expansion device connected to said second cooling device to receive said at least partially condensed first stream under pressure and expand said at least partially condensed first stream to a lower pressure, whereby said at least partially condensed first stream is further cooled, thereby forming an expanded further cooled first stream;

(e) a distillation column connected to said first expansion device to receive said expanded further cooled first stream at a top feed position, with said distillation column producing at least an overhead vapor stream and a bottom liquid stream;

(f) a second expansion device connected to said first divider to receive said cooled second stream under pressure and expand said cooled second stream to said lower pressure, thereby forming an expanded second stream;

(g) said distillation column further connected to said second expansion device to receive said expanded second stream at a mid-column feed position; and (h) said distillation column adapted to fractionate at least said expanded farther cooled first stream and said expanded second stream at said lower pressure whereby the components of said relatively less volatile fraction are recovered in said bottom liquid stream and said volatile residue gas fraction is discharged as said overhead vapor stream;

wherein said apparatus further includes (1) an absorbing section comprising one or more of packed beds and trays, wherein said absorbing section is housed in a single equipment item processing assembly and connected to said distillation column to receive said overhead vapor stream and contact said overhead vapor stream with a condensed stream, thereby condensing the less volatile components in said overhead vapor stream and forming a partially rectified vapor stream;

(2) a rectifying section providing simultaneous heat transfer and mass transfer selected from one or more of a fin and tube type exchanger, a plate type exchanger, a brazed aluminum type exchanger, and other type of heat transfer device, with said rectifying section housed in said single equipment item processing assembly and connected to said absorbing means to receive said partially rectified vapor stream from an upper region of said absorbing section, whereby said partially rectified vapor stream is cooled while simultaneously condensing the less volatile components in said partially rectified vapor stream, thereby forming a further rectified vapor stream and said condensed stream, said recti ring section being further connected to said absorbing section to direct said condensed stream to said absorbing section;

(3) a first combiner connected to said rectifying section to receive said further rectified vapor stream and a heated flash expanded stream and form a combined stream;

(4) a heat exchanger selected from one or more of a fin and tube type exchanger, a plate type exchanger, a brazed aluminum type exchanger, and other type of heat transfer device connected to said first combiner to receive and heat said combined stream, thereby forming a heated combined stream;

(5) a second divider connected to said heat exchanger to receive and divide said heated combined stream into a recycle stream and said volatile residue gas fraction;

(6) a compressor connected to said second divider to receive and compress said recycle stream to higher pressure, thereby forming a compressed stream;

(7) said heat exchanger further connected to said compressor to receive and cool said compressed stream to substantial condensation, thereby to supply at least a portion of the heating of step (4) and forming a substantially condensed stream;

(8) a third expansion device connected to said heat exchanger to receive and expand said substantially condensed stream to said lower pressure, thereby forming, a flash expanded stream;

(9) said rectifying section further connected to said third expansion device to receive and heat said flash expanded stream, thereby to supply the cooling of step (2) and forming said heated flash expanded stream;

(10) said heat exchanger further connected to said second cooling device to receive and further cool said at least partially condensed first stream under pressure, thereby to supply at least a portion of the heating of step (4) and forming a further cooled substantially condensed first stream;

(11) said first expansion device being adapted to connect it to said heat exchanger to receive and expand said further cooled substantially condensed first stream to said lower pressure, thereby forming said expanded further cooled first stream;

(12) a second combiner connected to said absorbing section and to said first expansion device to receive a distillation liquid stream from a lower region of said absorbing section and said expanded further cooled first stream and form a combined feed stream, said second combiner being further connected to said distillation column to supply said combined feed stream at said top feed position of said distillation column;

(13) said distillation column being adapted to fractionate at least said combined feed stream and said expanded second stream at said lower pressure whereby the components of said relatively less volatile fraction are recovered in said bottom liquid stream.

2. The apparatus according to claim 1 wherein (1) said first cooling device is adapted to cool and partially condense said gas stream under pressure, thereby forming a partially condensed gas stream;

(2) a separator is connected to said first cooling device to receive and separate said partially condensed gas stream into a vapor stream and at least one liquid stream;

(3) said first divider is adapted to be connected to said separator to receive and divide said vapor stream into at least said cooled first stream and said cooled second stream;

(4) a fourth expansion means is, connected to said separator to receive and expand at least a portion of said at least one liquid stream, to said lower pressure, thereby forming an expanded liquid stream, said fourth expansion means being further connected to said distillation column to supply said expanded liquid stream to said distillation column at a lower mid-column feed position below said mid-column feed position; and (5) said distillation column is adapted to fractionate at least said combined feed stream. said expanded second stream, and said expanded liquid stream at said lower pressure whereby the components of said relatively less volatile fraction are recovered in said bottom . liquid stream.

3. The apparatus according to claim 1 wherein (1) said first divider is adapted to divide said vapor stream into at least a cooled vapor stream and said second cooled stream;

(2) a third combiner is connected to said first divider and to said separator to receive said cooled vapor stream and at least a portion of said at least one liquid stream and form said cooled first stream;

(3) said first heat exchanger is adapted to be connected to said third combiner to receive said cooled first stream: and (4) said fourth expansion means is adapted to receive and expand any remaining portion of said at least one liquid stream to said lower pressure and form said expanded liquid stream.

* * * * *